US005540260A

United States Patent [19]

Mood

[11] Patent Number: 5,540,260

[45] Date of Patent: Jul. 30, 1996

[54] MULTI-AXIAL YARN STRUCTURE AND WEAVING METHOD

[75] Inventor: Geoffrey I. Mood, Tyne & Wear, United Kingdom

[73] Assignee: Short Brothers PLC, Northern Ireland

[21] Appl. No.: 295,887

[22] PCT Filed: Jan. 7, 1994

[86] PCT No.: PCT/GB94/00028

§ 371 Date: Nov. 7, 1994

§ 102(e) Date: Nov. 7, 1994

[87] PCT Pub. No.: WO94/16131

PCT Pub. Date: Jul. 21, 1994

[30] Foreign Application Priority Data

Jan. 8, 1993 [GB] United Kingdom ..... 9300304

[51] Int. Cl.[6] ..... D03D 13/00; D03D 25/00; D03D 41/00

[52] U.S. Cl. ..... 139/11; 139/DIG. 1

[58] Field of Search ..... 139/DIG. 1, 11

[56] References Cited

U.S. PATENT DOCUMENTS

| | | | |
|---|---|---|---|
| 3,799,209 | 3/1974 | Dow et al. . | |
| 3,999,578 | 12/1976 | Kulczycki . | |
| 4,031,922 | 6/1977 | Trost et al. . | |
| 5,137,058 | 8/1992 | Anahara et al. . | |
| 5,224,519 | 7/1993 | Farley | 139/DIG. 1 X |

FOREIGN PATENT DOCUMENTS

| | | |
|---|---|---|
| 0573132 | 12/1973 | European Pat. Off. . |
| 0263392 | 4/1988 | European Pat. Off. . |
| 2319822 | 10/1973 | Germany . |
| 9214876 | 9/1992 | WIPO . |

*Primary Examiner*—Andy Falik
*Attorney, Agent, or Firm*—Kenyon & Kenyon

[57] ABSTRACT

In a method of and machine for forming a non-woven bias yarn assembly comprising two superposed non-woven bias yarn sub-assemblies each yarn is transferred by a yarn transfer member from an opening it occupies in a yarn guide member to another opening in the yarn guide member in such a manner that each yarn is caused in a succession of forward transfer steps to follow the yarn preceding it from one opening to another along a non-intersecting path until the yarn at a first end opening in the path arrives at a second end opening in the path located at the opposite end of the path and the yarn at the second end opening in the path arrives at the first end opening and then in a succession of return transfer steps to follow the yarn preceding it from one opening to another along the non-intersecting path in the opposite direction until the yarn from the second end opening in the path arrives at the first end opening and the yarn from the first end opening arrives at the second end opening. The forward and return transfer steps are then successively repeated. A three dimensional yarn structure is also disclosed comprising a non-woven first yarn assembly which has a first face and an opposite second face and which comprises two or more superposed non-woven warp yarn sub-assemblies in which the warp yarns of one sub-assembly are inclined to the warp yarns of the other sub-assembly and in both of which the warp yarns are inclined to a reference warp feed direction.

25 Claims, 21 Drawing Sheets

MULTI-AXIAL YARN STRUCTURE AND WEAVING METHOD

FIELD OF THE INVENTION

The present invention relates to multi-axial yarn structures and is particularly although not exclusively concerned with a method of and machine for forming a three dimensional multi-axial yarn structure which embodies an assembly of bias yarns formed by two or more superposed non-woven bias yarn sub-assemblies in which the bias yarns of one sub-assembly are inclined to the bias yarns of the other sub-assembly and in both of which the bias yarns are inclined to a warp feed direction of the structure being formed.

By yarn is meant a continuous monofilament, an assembly of continuous filaments in the form of a tow or twisted together or a yarn spun from short fibres.

By warp feed direction is meant the direction in which warp yarns are fed and which is orthogonal to weft yarns in the structure being formed.

DESCRIPTION OF THE PRIOR ART

In EP 0263392-A2 there is disclosed a machine for forming a tetra-axial woven fabric embodying warp yarns, weft yarns and a bias yarn assembly having two bias yarn sub-assemblies in which the bias yarns of each are inclined to the bias yarns of the other and to the warp and weft yarns. In one form of fabric produced, the bias yarn sub-assemblies are arranged between the warp and weft yarns and the warp yarns are woven with the weft yarns hold the intermediate bias yarns in place in the fabric. The machine includes a bias yarn traversing device for progressively traversing yarns fed to it to provide the sub-assemblies of oppositely inclined bias yarns which are fed into the weaving zone where the warp yarns are woven with the weft yarns.

Three different forms of bias yarn traversing device are disclosed in EP0263392-A2. In a first form, two contra-rotating guide rolls are arranged one above the other. Each roll is provided with a helical groove by means of which yarns fed to the device are progressively traversed first along one of the rolls in a first weft direction and then along the other roll in an opposite weft direction and means are provided for transferring each yarn on its arrival at the end of one roll to the adjacent end of the other roll. In a second form of the bias yarn traversing device, an endless belt is provided having an upper horizontal run in which the belt moves in a first weft direction and a lower horizontal run in which the belt moves in an opposite weft direction. The belt is provided with spaced outwardly projecting guide pins along its length, which define openings through which yarns are fed and which guide the yarns so that the yarns in the upper run are traversed in one weft direction while the yarns in the lower run are traversed in the opposite weft direction, with the yarns transferring from one run to the other by being carried round with the belt which passes round supporting end sprockets. In a third form of the bias yarn traversing device, yarns in an upper run are progressively advanced in a first weft direction by engagement with grooves in shifting plate assembly and upon arrival at one end are transferred into a lower run where they are then traversed in a opposite direction by engagement in grooves in a further grooved shifting plate assembly.

In all three forms of the bias yarn traversing device disclosed in EP0263292-A2 the bias yarn formation is achieved by moving each yarn continuously and cyclically in one direction along a closed non-intersecting path. To accommodate such cyclical yarn movement, the bobbins supplying yarn to the devices are also required to move continuously in a closed path to prevent a winding up of the yarns upon each other on the supply side of the bias yarn traversing device. In particular, bobbins supplying the yarns are mounted on an annular creel on the supply side of the traversing device which is rotatable on supporting rollers for rotation in a plane perpendicular or inclined to the direction along which the fabric being formed is taken up.

The rotary annular creel however needs to be of substantial dimensions in relation to other parts of the machine in order to carry at its periphery the large plurality of bobbins needed for the supply of the yarns used in producing the bias yarns of the fabric. It is therefore cumbersome and special attention would be required in its design, maintenance and its use.

In U.S. Pat. No. 5,137,058 there is disclosed a machine for forming a three dimensional fabric embodying warp yarns, weft yarns, and non-woven bias yarns which are held together by binding warp yarns which pass through the yarn structure between adjacent warp yarns and which are held captive at the outer faces of the structure by weft yarns inserted at each face. The machine includes a bias yarn traversing device for progressively traversing yarns fed to it to provide sub-assemblies of oppositely inclined bias yarns which are fed into the weaving zone where they are held in place with the warp and weft yarns by the binding warp yarns.

A number of different forms of bias yarn traversing device is disclosed in U.S. Pat. No. 5,137,058. In one form, for example, the yarns of the device are passed through holes in an arrangement guide blocks with one block for each yarn and the blocks are caused to move continuously first along an upper horizontal run in which each block follows the one preceding it and each block on arrival at the end of the run is transferred to a lower horizontal run where it is progressively displaced in the opposite direction along the lower run until it reaches the end of the lower run where it is then moved back into the upper run. The traversing device in this form requires the use of a rotating creel which takes the form of an endless belt or chain which supports the bias yarn supply packages and causes them to follow the movement of the bias yarns in the bias yarn traversing device. In this form, the traversing device suffers the same disadvantage as that found in the different forms of the device disclosed in EP0263392 insofar that it requires a cumbersome endless belt creel for supporting the large plurality of supply packages.

There is also disclosed in U.S. Pat. No. 5,137,058 a bias yarn traversing device which does not require the use of a rotary creel for the supply of yarns to it but which is itself of considerable mechanical complexity. It requires at least four rotationally driven helically grooved rolls in its operation. In this form of the traversing device, an upper row of bias yarns engage in spaced sections of a helical groove formed in an upper first roll while a second row of yarns engage in spaced sections of a helical groove in a lower second roll positioned beneath it and the arrangement is such that the yarns of the lower second roll are progressively fed to a free end of that roll and pass downwardly onto one root end of a third roll positioned beneath it while the yarns on the upper first roll are advanced by the groove in it to the free end of that roll where they then pass down onto the root end of the second roll. When all the yarns from the upper and intermediate rolls have been transferred to the second and third rolls the empty first roll is moved away; the second and third rolls are raised and a fourth roll moved into position beneath the second and third rolls so that the yarns can then be traversed along the second and third rolls until they fill the third and fourth. All four rolls need to be rotatably driven about their axes, to be moved axially and also to be moved transversely with respect to their axes to achieve the continuous transfer of yarns which produces the required bias yarn configuration. The traversing device is therefore cumbersome and of considerable mechanical complexity and special attention would be required to be given to its design, maintenance and its use.

It is an object of the present invention to provide a method of and machine for producing a multi-axial yarn structure embodying a non-woven bias yarn assembly of two superposed non-woven bias yarn sub-assemblies which does not require the use of a rotary creel or its equivalent for the supply of bias yarns and does not have the disadvantage of the mechanical complexity of the bias yarn traversing device hitherto proposed which employs four helically grooved rolls.

In WIPO publication WO92/14876 a method of forming a three-dimensional woven fabric is disclosed in which use is made of a yarn transfer device for transferring yarns in the weft direction to provide bias yarn arrays in which the yarns are inclined to the warp feed direction and in which the arrays of inclined bias yarns are woven into ether arrays of yarns by selective shedding of the yarns and insertion of weft yarns to produce the three-dimensional fabric in this method, each yarn which is to form a bias yarn needs to be detachably engaged by a yarn engaging heald for selectively raising and lowering the yarn during the weaving process. The weaving process is therefore complex where several sets of two dimensional bias yarn assemblies need to be interwoven to provide a three dimensional woven structure since repeated engagement of the yarns by the healds and their disengagement from the healds is required, which inevitably leads to relatively slow fabric production rates resulting either from the need to operate the machine at modest speeds or to take account of long downtime periods due to yarn breakage. It also calls for a high degree of reliability and does not tolerate mistakes made by operatives when setting up the machine.

The method disclosed in WO92/14876 nevertheless enables three-dimensional woven yarn structures to be produced which are of complex form and in particular enables the production of three-dimensional multi-axial woven yarn structures such as tetra-axial structures including 0°, 90° and ±45° yarn assemblies.

Such complex yarn structures find application in advanced composites where they are used as structural reinforcements. Their use gives rise to improvements in strength and damage tolerance of the composites thus formed especially in thick section composites. Furthermore, they offer the unique capability that the preform can be designed to meet the needs of the performance of the composite.

It is a further object of the present invention to provide a method of and machine for forming a multi-axial yarn structure in which repeated engagement and disengagement of yarns from healds in the weaving process disclosed in WO92/14875 can be avoided.

SUMMARY OF THE INVENTION

According to first aspect of the present invention there is provided a method of forming a multi-axial yarn structure comprising the steps of advancing in a warp feed direction warp yarns in the form of a warp sheet, forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, characterized in that each bias yarn forming step comprises advancing the yarns through yarn guide openings of yarn guide means to hold the warp yarns in predetermined relative positions along the weft direction, shedding selected warp yarns on the supply side of the yarn guide means to transfer the selected yarns from predetermined openings in the yarn guide means to openings in a yarn transfer means located at a predetermined initial yarn receiving position with respect to the yarn guide means, bringing the yarn transfer means to an offset position offset in the weft direction from the predetermined yarn receiving position by relative displacement of the yarn transfer means and the yarn guide means in the weft direction and returning the selected warp yarns to the warp sheet to bring them into offset openings in the yarn guide means offset from the predetermined openings in the yarn guide means and further characterized in that the method comprises carrying out the bias yarn forming steps to transfer each yarn from the opening it occupies in the yarn guide means to another opening in the yarn guide means in such a manner that each yarn is caused in a succession of forward transfer steps to follow the yarn preceding it from one opening to another along a non-intersecting path until the yarn at a first end opening in the path arrives at a second end opening in the path located at the opposite end of the path from the first end opening and the yarn at the second end opening in the path arrives at the first end opening and then in a succession of return transfer steps to follow the yarn preceding it from one opening to another along the non-intersecting path in the opposite direction until the yarn from the second end opening in the path arrives at the first end opening and the yarn from the first end opening arrives at the second end opening and successively repeating the forward and return transfer steps.

In a preferred embodiment of the invention according to its first aspect, the method comprises advancing a first yarn through a first yarn guide opening located at one end of the yarn guide means, two yarns through each of a plurality of intermediate openings intermediate the first yarn guide opening and a last yarn guide opening and passing a last yarn through the last yarn guide opening, shedding in a first forward yarn transfer step the first and last and all the yarns in the intermediate openings to transfer them to corresponding openings in the yarn transfer means, moving the yarn transfer means one traverse space equal to one opening or a predetermined plurality of openings of the yarn guide means in a first weft direction and returning one yarn required to be moved in the first direction from each of the intermediate openings to offset openings in the yarn guide means, moving the yarn transfer means two traverse spaces in a second weft direction opposite the first weft direction and returning the remaining yarns from the intermediate openings and the last yarn to offset openings in the yarn guide means offset two openings spaces in the second weft direction, moving the yarn transfer means two traverse spaces in the first weft direction and returning the yarn from the first yarn guide opening to an offset opening in the yarn guide means offset one opening in the first weft direction, moving the yarn transfer means back one traverse space to its predetermined initial yarn receiving position to complete the first forward yarn transfer step, repeating the forward transfer step on the transferred yarns until the succession of forward transfer steps has been completed while, during transfer, including with the first yarn each successive yarn arriving at the first opening and then carrying out the succession of return yarn transfer steps in each of which movement of the yarn transfer means is reversed and the yarns shed and transferred in the opposite weft directions to bring them back into the yarn guide openings they occupied at the commencement of the first forward yarn transfer step.

In accordance with an embodiment of the invention hereinafter to be described the method according to the first aspect of the invention is characterized by the further steps of passing in each of a succession of binding warp yarn inserting steps binding warp yarns through the non-woven bias yarn assembly to form for each binding warp yarn a first portion which passes through the non-woven bias yarn assembly from a first face thereof to an opposite second face thereof, a second portion which passes from the second face to the first face and a binding warp yarn loop portion which bridges the first and second portions at the second face, passing in the weft direction in each of a succession of weft insertion steps a holding weft yarn across the second face of the non-woven bias yarn assembly and through the binding yarn loop portions thereby to hold the binding warp yarns captive at the second face of the bias yarn assembly, and passing in the weft direction a holding weft yarn across the first face of the bias yarn assembly on the feed side of the second portions of the binding warp yarns and repeating the binding warp yarn insertion step to form bridging binding yarn loop portions at the first face of the bias yarn which are held captive at the first face of the assembly by the holding weft yarns at the first face and beating up in a beating up step the structure thus formed to produce a three dimensional yarn structure, in which the yarns of the superposed bias yarn sub-assemblies are held in place in the structure by the binding warp yarns which are held by the holding weft yarns.

In an embodiment of the invention hereinafter to be described the non-woven bias yarn assembly is a first of a plurality of yarn assemblies, a second yarn assembly is formed over the second face of the non-woven first assembly and the method further comprises the steps of advancing in the feed direction warp yarns of the second yarn assembly in the form of a warp sheet, passing the binding warp yarns through the superposed sub-assemblies of the non-woven first assembly and the warp sheet of the second assembly to form the binding yarn loop portions, shedding the warp yarns of the warp sheet of the second assembly and inserting holding weft yarns to form a woven second assembly and to hold the binding warp yarn loop portions captive at the second face of the first assembly.

According to a second aspect of the present invention there is provided a method of forming a three dimensional yarn structure comprising the steps of advancing in a warp feed direction warp yarns in the form of a warp sheet, displacing in a succession of bias yarn forming steps warp yarns of the warp sheet in opposite weft directions to produce a non-woven bias first yarn assembly comprising two or more superposed non-woven bias yarn sub-assemblies in which the bias yarns of one sub-assembly are inclined to the bias yarns of the other sub-assembly and in both of which the bias yarns are inclined to the feed direction, passing in each of a succession of binding warp yarn inserting steps binding warp yarns through the non-woven bias yarn assembly to form for each binding warp yarn a first portion which passes through the non-woven bias yarn assembly from a first face thereof to an opposite second face thereof, a second portion which passes from the second face to the first face and a binding warp yarn loop portion which bridges the first and second portions at the second face, passing in the weft direction in each of a succession of weft insertion steps a holding weft yarn across the second face of the assembly and through the binding yarn loop portions thereby to hold the binding warp yarns captive at the second face of the bias yarn assembly, and passing in the weft direction a holding weft yarn across the first face of the bias yarn assembly on the feed side of the second portions of the binding warp yarns and repeating the binding warp yarn insertion step to form bridging binding yarn loop portions at the first face of the bias yarn which are held captive at the first face of the assembly by the holding weft yarns at the first face and beating up in a bearing up step the structure thus formed to produce a three dimensional yarn structure, in which the yarns of the superposed bias yarn sub-assemblies are held in place in the structure by the binding warp yarns which are held by the holding weft yarns characterized in that the non-woven bias yarn assembly is a first of plurality of yarn assemblies, a second yarn assembly is formed over the second face of the non-woven first assembly and the method further comprises the steps of advancing in the feed direction warp yarns of the second yarn assembly in the form of a warp sheet, passing the binding warp yarns through the superposed sub-assemblies of the non-woven first assembly and the warp sheet of the second assembly to form the binding yarn loop portions, shedding the warp yarns of the warp sheet of the second assembly and inserting holding weft yarns to form a woven second assembly and to hold the binding warp yarn loop portions captive at the second face of the first assembly.

In one of the embodiments of the invention hereinafter to be described a third yarn assembly is formed over the first face of the non-woven first assembly and the method further comprises the steps of advancing in the feed direction warp yarns of the third yarn assembly in the form of a warp sheet, passing the binding warp yarns through the warp sheet of the third yarn assembly, the superposed sub-assemblies of the non-woven first assembly and the warp sheet of the second assembly to form the binding yarn loop portions, shedding the warp yarns of the warp sheet of the second yarn assembly and inserting holding weft yarns to form a woven second assembly and to hold the binding warp yarn loop portions captive at the second face of the first assembly, shedding the warp yarns of the warp sheet of the third yarn assembly and inserting holding weft yarns to form a woven third yarn assembly and to hold the binding warp yarn loop portions captive at the first face of the first assembly whereby the yarns of the superposed yarn sub-assemblies of the first assembly are held in place in the structure by binding warp yarns held by the holding weft yarns of the woven second and third yarn assemblies.

In each of the embodiments of the invention hereinafter to be described the three-dimensional yarn structure to be formed comprises in at least a first region thereof a main body portion having a first outer face and an opposite second outer face, the binding warp yarn inserting steps of the method comprise passing binding warp yarns through the non-woven bias yarn assembly from the first outer face of the body portion to the opposite second outer face of the body portion and the weft yarn insertion steps of the method comprise passing holding weft yarns across the first and second outer faces to hold the binding yarn loop portions captive at the first and second outer faces.

The three-dimensional yarn structure to be formed may then comprise in a second region thereof first and second superposed sub-portions the first of which extends from the main body portion and has an outer face and an inner face and the second of which extends from the main body portion and has an outer face and an inner face opposing the inner face of the first sub-portion. The binding warp yarn inserting steps of the method then comprise passing binding warp yarns through the non-woven warp yarn assembly from the outer face of the first sub-portion to the inner face thereof and the weft insertion steps of the method then comprise passing holding weft yarns across the outer face and the inner face of the first sub-portion to hold captive the binding yarn loop portions at the outer and inner faces of the first sub-portion.

In an embodiment of the invention hereinafter to be described the second region of the structure to be formed includes a non-woven assembly. The binding warp yarn inserting steps of the method then include passing binding warp yarns through the non-woven warp yarn assembly in the second sub-portion from the outer face thereof to the inner face thereof and the weft insertion steps of the method include passing holding weft yarns across the outer face and the inner face of the second sub-portion to hold captive the binding yarn loop portions at the outer and inner faces of the second sub-portion.

According to a third aspect of the present invention there is provided a machine for forming a multi-axial yarn structure comprising supply means for supplying in a warp feed direction warp yarns in the form of a warp sheet, and bias yarn forming means for forming in a succession of bias yarn forming steps in which warp yarns of the warp sheet are displaced in opposite weft directions to form a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, characterized in that the bias yarn forming means comprises yarn guide means defining yarn guide openings through which the warp yarns of the warp sheet pass and which hold the warp yarns in predetermined relative positions along the weft direction, yarn transfer means defining yarn transfer openings and being located at a predetermined initial yarn receiving position with respect to the yarn guide means, shedding means on the supply side of the yarn guide means for shedding selected warp yarns to transfer the selected yarns from predetermined openings in the yarn guide means to yarn transfer openings in the yarn transfer means at the initial yarn receiving position, yarn transfer drive means to cause relative displacement of the yarn transfer means and the yarn guide means in the weft direction to bring the yarn transfer means to an offset position offset from the yarn receiving position and thereby to bring the selected warp yarns upon their return to the warp sheet into openings in the yarn guide means offset from the predetermined openings in the yarn guide means and drive control means to drive the shedding means and the yarn transfer drive means to transfer each yarn from the opening it occupies in the yarn guide means to another opening in the yarn guide means in such a manner that each yarn is caused in a succession of forward transfer steps to follow the yarn preceding it from one opening to another along a non-intersecting path until the yarn at a first end opening in the path arrives at a second end opening in the path located at the opposite end of the path from the first end opening and the yarn at the second end opening in the path arrives at the first end opening and then in a succession of return transfer steps to follow the yarn preceding it from one opening to another along the non-intersecting path in the opposite direction until the yarn from the second end opening in the path arrives at the first end opening and the yarn from the first end opening arrives at the second end opening and successively repeating the forward and return transfer steps.

According to a fourth aspect of the present invention there is provided a machine for forming a three dimensional yarn structure comprising supply means for supplying in a wary feed direction warp yarns in the form of a warp sheet, bias yarn forming means for forming in a succession or bias yarn forming steps in which warp yarns of the ward sheet are displaced in opposite directions a non-woven bias yarn assembly comprising two or more superposed non-woven bias yarn sub-assemblies in which the bias yarns of one sub-assembly are inclined to the bias yarns of the other sub-assembly and both of which the bias yarns are inclined to the feed direction, binding warp yarn insertion means for passing in each of a succession of binding warp yarn inserting steps binding warp yarns through the non-woven warp yarn assembly to form for each binding warp yarn a first portion which passes through the non-woven first yarn assembly from a first face thereof to an opposite face thereof, a second portion which passes from the second face to the first face and a binding warp yarn loop portion which bridges the first and second portions at the second face, weft insertion means for passing in the weft direction in each of a succession of weft insertion steps a holding weft yarn across the second face of the assembly and through the binding yarn loop portions thereby to hold the binding warp yarns captive at the second face of the assembly, and passing in the weft direction a holding weft yarn across the first face of the assembly on the supply side of the second portions of the binding ward yarns whereby repetition of the binding yarn insertion step forms bridging yarn loop portions at the first face which are held captive at the first face of the assembly by the holding weft yarns at the first face and beater means for beating up to produce a three dimensional yarn structure, in which the yarns of the superposed sub-assemblies of the first assembly are held in place in the structure by the binding warp yarns which are held by the holding weft yarns, characterised in that the non-woven assembly is a first of a plurality of yarn assemblies, a second yarn assembly is formed over the second face of the non-woven first assembly, wherein the supply means supplies in the feed direction warp yarns of the second yarn assembly in the form of a warp sheet, and further characterized in the machine further comprises shedding means for shedding the warp yarns of the warp sheet of the second assembly after passage of the binding warp yarns through the superposed sub-assemblies of the non-woven first assembly and the warp sheet of the second assembly to form the binding yarn loop portions, and wherein the weft insertion means is arranged to insert holding weft yarns to form a woven second assembly and hold the binding warp yarn loop portions captive at the second face of the first assembly.

In embodiments of the invention hereinafter to be described the machine according to the third and fourth aspects of the invention are provided with means for carrying out the steps hereinbefore set forth in the methods according to the first and second aspects of the invention.

According to a fifth aspect of the present invention there is provided a three dimensional yarn structure comprising a non-woven first yarn assembly which has a first face and an opposite second face and which comprises two or more superposed non-woven warp yarn sub-assemblies in which the warp yarns of one sub-assembly are inclined to the warp yarns of the other sub-assembly and in both of which the warp yarns are inclined to a reference ward feed direction, a second yarn assembly which comprises holding weft yarns which extend across the second face of the first assembly, a third yarn assembly comprising holding weft yarns which extend across the first face of the first assembly and a binding yarn assembly comprising binding warp yarns each of which follows a continuous path and comprises first portions which pass through the non-woven first yarn assembly from the first face thereof to the second face thereof, second portions which pass from the second face to the first face and binding yarn loop portions bridging the first and second portions at the first face of the first assembly and binding yarn loop portions bridging the first and second portions at the second face of the first assembly, holding weft yarns of the second assembly passing through binding yarn loop portions at the second face of the first assembly to hold the binding yarn loop portions captive at the second face of the first assembly and holding weft yarns of the third assembly passing through the yarn binding loop portions at the first face of the first assembly to hold the loop portions captive at the first face of the first assembly, characterized in that the second yarn assembly comprises a warp yarn sub-assembly and a weft yarn sub-assembly which includes the holding weft yarns which are woven with the warp yarns of the warp yarn sub-assembly to form the second yarn assembly.

In an embodiment of the fifth aspect of the invention as hereinafter to be described the third yarn assembly comprises a warp yarn sub-assembly and a weft yarn sub-assembly which includes the holding weft yarns which are woven with the warp yarns of the warp yarn sub-assembly to form the third yarn assembly.

In an embodiment of the fifth aspect of the invention the structure comprises in at least a first region thereof a main body portion having a first outer face and an opposite second outer face, wherein in the first region the first face of the non-woven yarn assembly is the first outer face of the body portion and the second face of the non-woven yarn assembly is the opposite second outer face of the body portion.

In an embodiment of the fifth aspect of the invention the structure in a second region thereof comprises first and second superposed sub-portions the first of which extends from the main body portion and has an outer face and an inner face and the second of which extends from the main body portion and has outer face and an inner face opposing the inner face of the first sub-portion, the first sub-portion in the second region includes the non-woven assembly and in the second region the first face of the non-woven yarn assembly is the outer face of the first sub-portion and the second face of the non-woven assembly is the inner face of the first sub-portion.

In an embodiment of the fifth aspect of the invention hereinafter to be described the second sub-portion includes a non-woven yarn assembly and in the second region the first face of the non-woven assembly is the outer face of the second sub-portion and the second face of the non-woven assembly is the inner face of the second sub-portion. The first and second sub-portions may be separable sub-portions.

Embodiments of the invention will now be described by way of example with reference to the accompanying drawings in which:

DESCRIPTION OF THE PREFERRED EMBODIMENTS

Figure 1A:
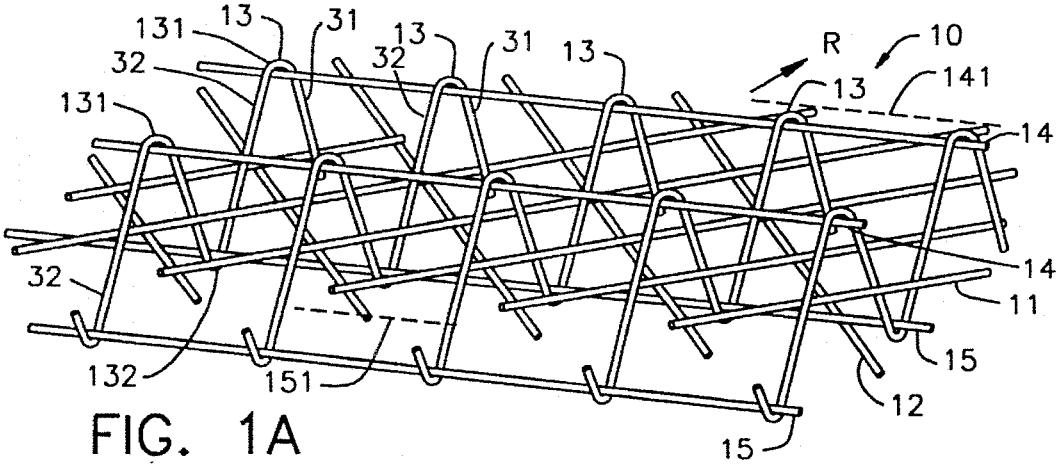
FIGS. 1A, 1B and 1C are schematic perspective views of three three-dimensional yarn structures produced by the method according to of the invention.

Referring first to FIG. 1A, a three-dimensional yarn structure is schematically illustrated and comprises a non-woven warp yarn assembly composed of two superposed non-woven diagonal sub-assemblies of warp yarns 11 and 12 arranged at angles of ±45° to the reference warp direction R, a binding warp yarn assembly comprising binding warp yarns 11 extending in the warp feed direction and passing through the non-woven diagonal warp yarn sub-assemblies 11 and 12, from a first face 141 of the non-woven warp yarn assembly as defined by the sub-assembly of bias yarns 11 to a second opposite face 151 of the non-woven warp yarn assembly as defined by the sub-assembly of bias yarns 12 an upper weft yarn assembly comprising weft yarns 14 and a lower weft yarn assembly comprising weft yarns 15. As will be seen, the binding warp yarns 13 are continuous in the warp direction and comprise portions 31 and 32 extending through the assembly and upper and lower loop portions 131 and 132 held captive by the upper and lower weft yarns 14 and 15

Figure 2A:
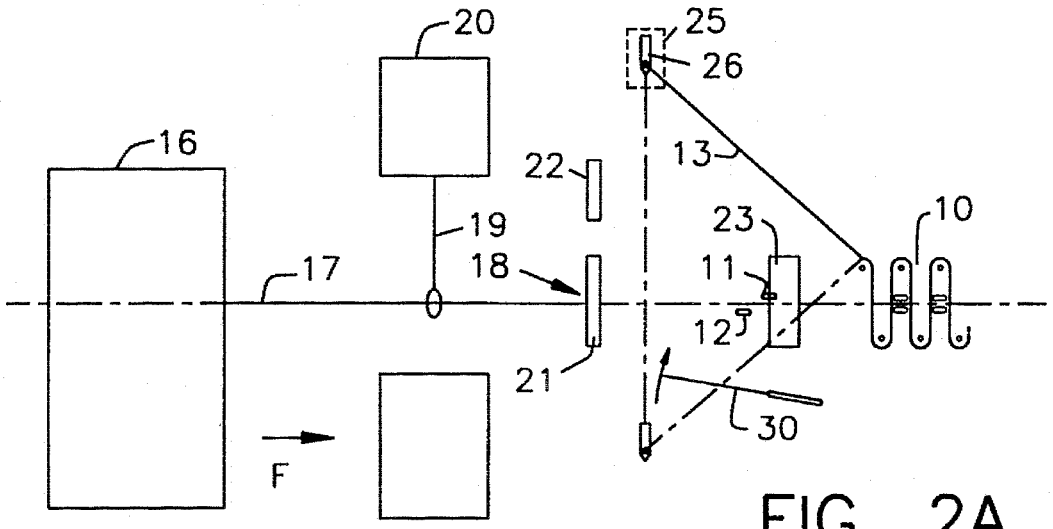
FIGS. 2A, 2B and 2C are block schematic diagrams of three yarn structure forming machines according to one invention for forming the yarn structures illustrated in FIGS. 1A, 1B and 1C.

A yarn structure forming machine for forming the yarn structure illustrated in FIG. 1A is shown in FIG. 2A and comprises a creel 16 which supplies warp yarns in a warp sheet 17 in a ward feed direction F to a yarn displacement mechanism 18 following passage through yarn support elements 19 of a jacquard mechanism 20. Each warp yarn of the warp sheet 17 is supported by its own yarn support element 19 which can be raised and lowered under the control of the mechanism 20 to form sheds in which warp yarns of the warp sheet 17 are raised. Such mechanisms are well known in the art and although can be used for making complex selections for the shedding of the warp sheet in the formation of fabrics of intricate pattern the mechanism provided in the machine illustrated in FIG. 2A is employed simply for raising and lowering warp yarns of the warp sheet 17 during yarn transfer carried out by a yarn transfer mechanism 18.

The yarn transfer mechanism 18 comprises a lower yarn guide member 21 which extends in the weft direction throughout the width of the warp sheet 17 and includes upstanding yarn guide elements which extend through the thickness of the warp sheet 17 and define warp yarn guide openings through which the warp yarns of the warp sheet 17 pass and which hold the warp yarns in predetermined positions spaced apart in the weft direction and a warp yarn transfer member 22 which also extends in the weft direction and which includes yarn guide elements defining transfer openings for the reception of yarns of the warp sheet 17 for transfer to produce the ward yarns 11 and 12 which are to form part of the yarn structure produced on the machine.

The machine shown in FIG. 2A also includes a weft insertion station 23 for inserting the weft yarns 14 of the structure shown in FIG. 1A.

The machine shown in FIG. 2A furthermore includes a binding warp yarn insertion mechanism 25 which includes an insertion needle 26 which provides for the insertion of the binding warp yarns 13 of the structure 10 shown in FIG. 1A. It also includes a beater 30.

The yarn transfer mechanism 18 in the machine illustrated in FIG. 2A serves progressively to move the warp yarns of the warp sheet 17 into diagonal ±45° non-woven warp yarn sub-assemblies as represented by the warp yarns 11 and 12 of the structure shown in FIG. 1A. The manner of operation of the mechanism will now be described with reference to FIGS. 3A(i) to FIG. 3H(vii) for accomplishing the transfer.

Figures 1, 3A:
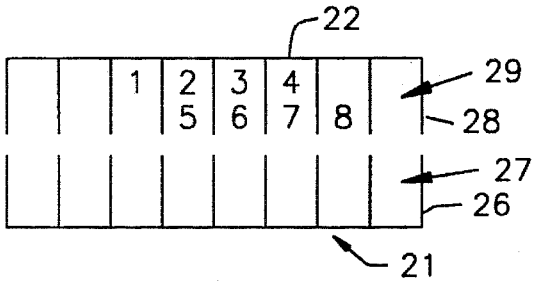
FIGS. 3A(i) to 3H(vii) are schematic diagrams of a yarn transfer mechanism of the machines shown in FIGS. 2A, 2B and 2C, illustrating successive yarn transfer steps in the transfer of yarns in the production of two superposed non-woven bias yarn sub-assemblies of the yarn structure shown in FIGS. 1A, 1B and 1C.
Figures 2, 3A:
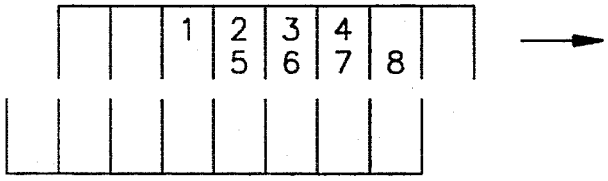
Figures 3, 3A:
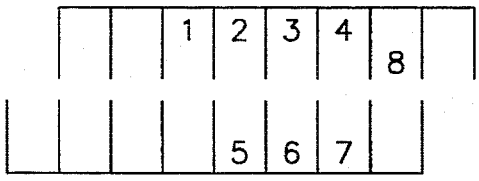

Referring first to FIG. 3A(i), the yarn guide member 21 is schematically illustrated and includes a large plurality of upstanding yarn guide elements 26 which provide yarn guide openings 27 through which warp yarns of the warp sheet 17 pass, with the yarn guide elements 26 serving to hold warp yarns in predetermined positions spaced apart in the weft direction for subsequent insertion of the binding warp yarns and the insertion of weft yarns. The yarn transfer member 22 takes the same form as the yarn guide member 21 and is provided with a like plurality of yarn guide elements 28 which define transfer openings 29 to which warp yarns from the guide member 21 can be transferred for their transfer to another yarn guide opening 27 in the yarn guide member 21.

The yarn guide member 21 in FIG. 3A(i) is shown for illustrative purposes with seven yarn guide openings and the yarn transfer member 22 is likewise provided with an equal number of yarn transfer openings 29. In the disposition shown in FIG. 3A(i) the yarn transfer member 22 appears in an initial receiving position with the seven openings 29 directly opposed to the seven openings 27 in the guide member 21. For illustrative purposes, eight yarns only of the yarns required to produce the bias yarn sub-assemblies of the yarn structure to be formed are represented by numerals 1 to 8.

The yarns 1 to 8 will initially have occupied openings in the yarn guide member 21 and in a first forward yarn transfer step to be carried out all the yarns 1 to 8 are transferred to corresponding transfer openings 29 as shown in FIG. 2A(i) during an initial first movement in the first forward yarn transfer step. Accordingly, the first yarn 1 will have occupied before transfer a first end opening in the yarn guide member 21, the last yarn 8 will have occupied an opposite end opening and each of the pair of yarns 2,5; 3,6; and 4,7 will have occupied intermediate openings.

With the yarns located in the yarn transfer member 22 as illustrated in FIG. 3A(i) the yarn transfer member 22 is moved one opening in a first weft direction (to the right in the drawing) as illustrated in FIG. 3A(ii). One yarn from each of the intermediate openings which is required to be moved to the right in the figure is then returned to openings in the yarn guide member 21 as illustrated in FIG. 3A(iii) which shows the return of yarns 5, 6 and 7. The yarn transfer member 22 is then moved two openings in an opposite second weft direction (to the left in the figure and as illustrated in FIG. 3A(iv) following which the remaining yarns 2, 3 and 4 from the intermediate openings and the last yarn 8 are returned to openings in the yarn guide member 21 as illustrated in FIG. 3A(v). As will be seen, the first yarn 1 remains in the yarn transfer member 22. The yarn transfer member 22 is then moved two openings in the first weft direction (to the right in the drawing) to the position illustrated in FIG. 3A(vi) following which the first yarn 1 is lowered into the yarn guide member 21 as illustrated in FIG. 3A(vii). The yarn transfer member 22 is then moved one opening in the second weft direction to bring it back to its initial receiving position.

Figures 3, 3A, 4:
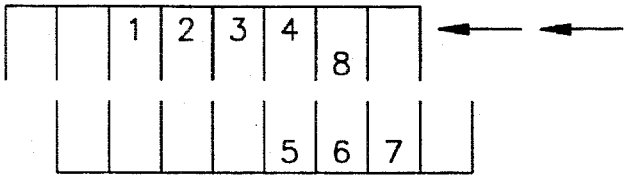
FIG. 4(i) to FIG. 4(viii) are schematic diagrams illustrating successive steps in a complete cycle of operation of the machine illustrated in FIG. 2A for forming the three-dimensional yarn structure illustrated in FIG. 1A.
Figures 3, 3A, 4, 5:
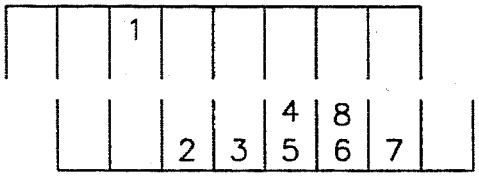
FIG. 5(i) to FIG. 5(viii) are schematic diagrams illustrating successive steps in a complete cycle of operation of the machine illustrated in FIG. 2B for producing the structure illustrated in FIG. 1B.
Figures 3, 3A, 4, 5, 6:
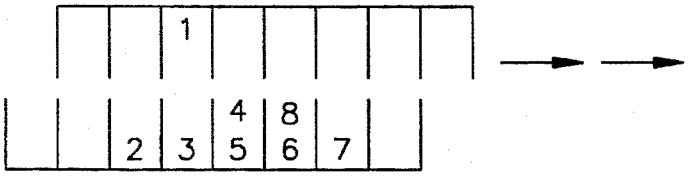
Figures 3, 3A, 4, 5, 6, 7:
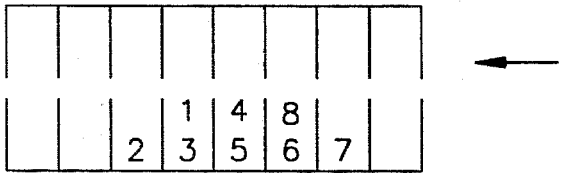
FIG. 7 is a block schematic diagram of the yarn structure forming machine illustrated in FIG. 2C, including an automatic drive control unit for use in controlling the production of yarn structures according to the invention.
Figures 1, 3B:
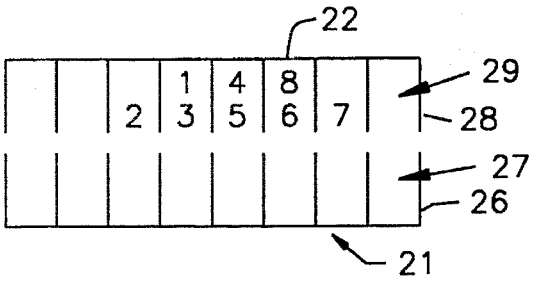
Figures 2, 3B:
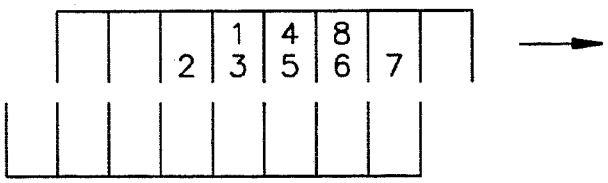
Figures 3, 3B:
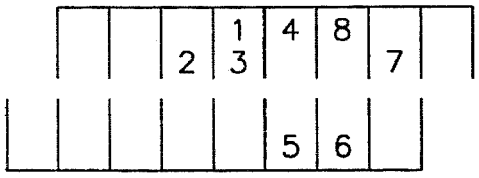
Figures 3, 3B, 4:
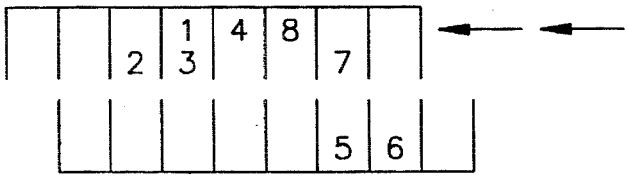
Figures 3, 3B, 4, 5:
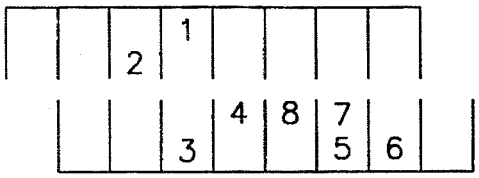
Figures 3, 3B, 4, 5, 6:
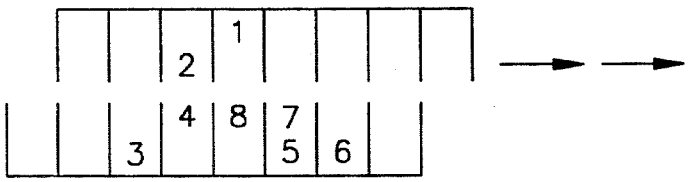
Figures 3, 3B, 4, 5, 6, 7:
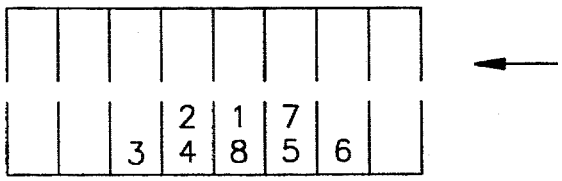

The movement or yarns carried out in a first forward transfer step described with reference to FIG. 3A(i) to 3A(vii) is then repeated in a second forward transfer step on the yarn configuration appearing in FIG. 3A(vii), that is to say, on a first yarn 2, three intermediate pairs of yarns 1,3; 4,5; and 8,6 and a last yarn 7, as illustrated in FIG. 3B(i) to 3B(vii), except insofar that there is included with the transfer of the first yarn 1 the yarn 2 which has arrived at the first opening in the yarn guide member 21.

As to the movement of yarns in the second forward transfer step as illustrated in FIG. 3B(i) to 3B(vii) it will be seen that all the yarns are first moved up into the yarn transfer member 22 as illustrated in FIG. 3B(i) the yarn transfer member 22 is moved one opening to the right in the figure, the yarns from the intermediate openings which are required to move to the right are then returned to the yarn guide member 21 as illustrated in FIG. 3B(iii); the yarn transfer member 22 is then moved two openings to the left in the figure as illustrated in FIG. 3B(iv); the remaining yarns in the transfer member 22 are returned to openings in the yarn guide member 21 as illustrated in FIG. 3B(v) except for yarns 1 and 2; the yarn transfer member 22 is then moved two openings to the right; the yarns 1 and 2 are then returned to the yarn guide member 21 to take up the position shown in FIG. 3B(vii); and the yarn transfer member 22 is then returned to its initial receiving position.

Figures 1, 3C:
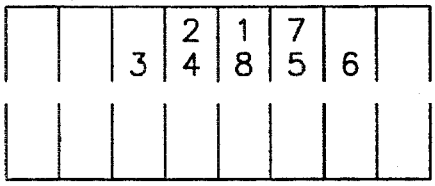
Figures 2, 3C:
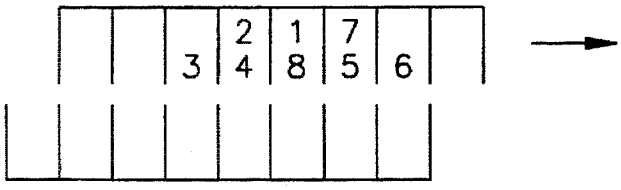
Figures 3, 3C:
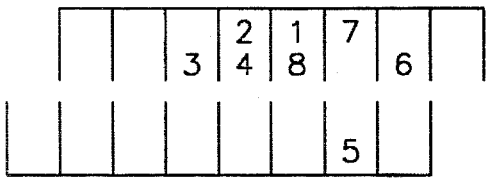
Figures 3, 3C, 4:
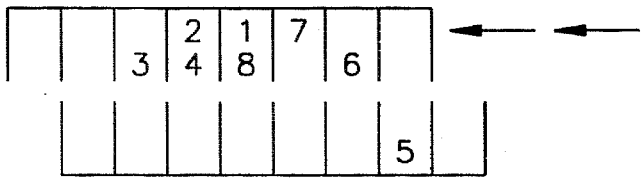
Figures 3, 3C, 4, 5:
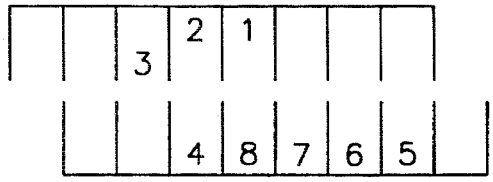
Figures 3, 3C, 4, 5, 6:
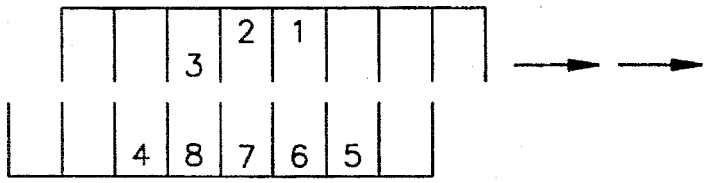
Figures 3, 3C, 4, 5, 6, 7:
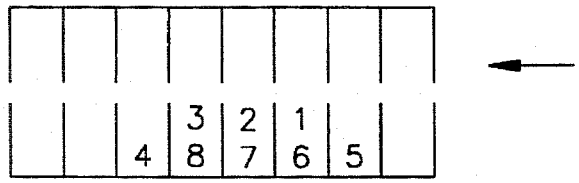
Figures 1, 3D:
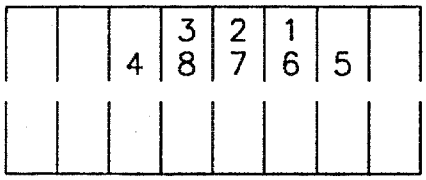
Figures 2, 3D:
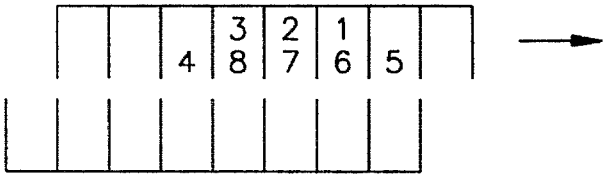
Figures 3, 3D:
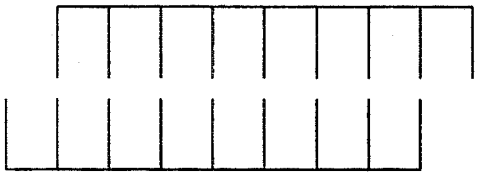
Figures 3, 3D, 4:
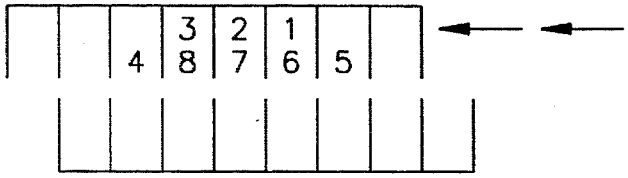
Figures 3, 3D, 4, 5:
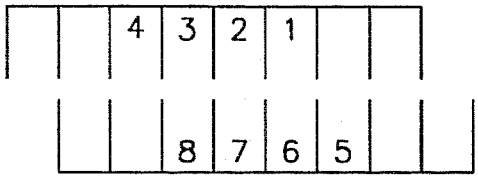
Figures 3, 3D, 4, 5, 6:
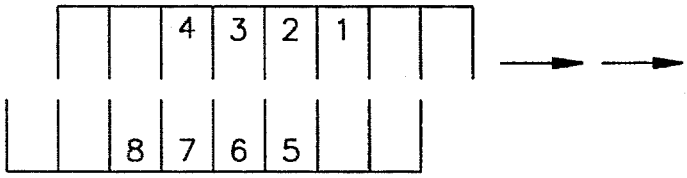
Figures 3, 3D, 4, 5, 6, 7:
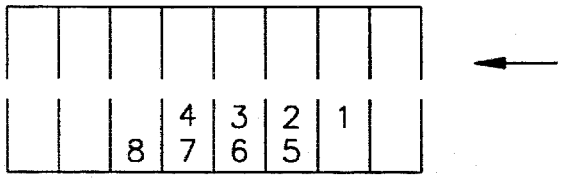

A third forward transfer step is carried out as illustrated in FIG. 3C(i) to FIG. 3C(vii) and a fourth forward transfer step as illustrated in FIGS. 3D(i) to FIG. 3D(vii), which then brings the yarns into an opposite order in the openings in the yarn guide member 21 with the yarn 1 occupying the last end opening and the yarn 8 in the first end opening.

The succession of forward transfer steps as described with reference to FIG. 3A(i) to FIG. 2D(vii) is then followed by a succession of return transfer steps in each of which movement of the yarn transfer member 22 is reversed and the yarns transferred in opposite weft directions to bring them back into the openings which they occupied at the commencement of the first forward transfer step.

Figures 1, 3E:
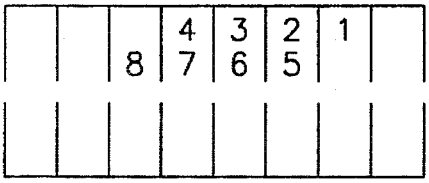
Figures 2, 3E:
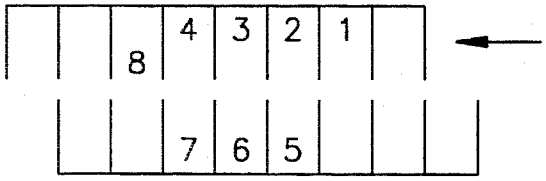
Figures 3, 3E:
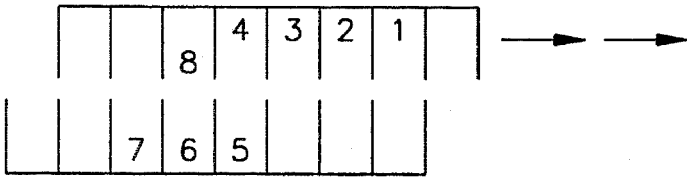
Figures 3, 3E, 4:
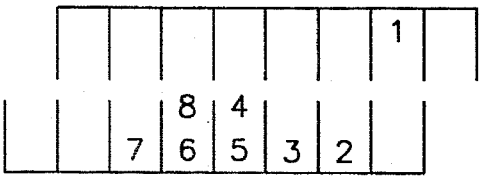
Figures 3, 3E, 4, 5:
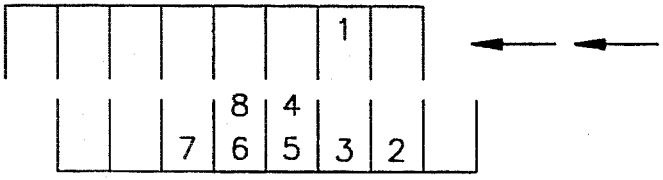
Figures 3, 3E, 4, 5, 6:
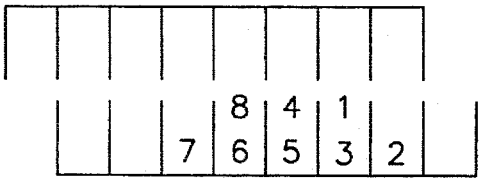
Figures 3, 3E, 4, 5, 6, 7:
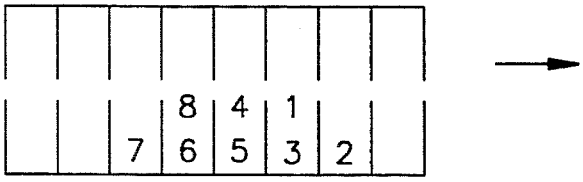

The first return transfer step is illustrated in FIG. 3E(i) to FIG. 3E(vii) and commences with transfer of the yarns in the configuration shown in FIG. 3D(vii) to the yarn transfer member 22 as illustrated in FIG. 3E(i). The yarn transfer member 22 is then moved one opening to the left in the figure and the yarns 7, 6 and 5 in the intermediate openings which are required to be moved to the left in the figure are returned to the yarn guide member 21. The yarn transfer member 22 is then moved two openings to the right and the remaining yarns in it except yarn 1 are returned to the yarn guide member 21 as illustrated in FIG. 3E(iv). The yarn transfer member 22 is then moved two openings to the left as illustrated in FIG. 3E(v) and the yarn 1 is then returned to the yarn guide member 21 as illustrated in FIG. 3E(vi). The yarn transfer member is then moved one opening to the right to return it to the initial yarn receiving position with the yarns in the yarn guide member 21 occupying the positions illustrated in FIG. 3E(vii).

Figures 1, 3F:
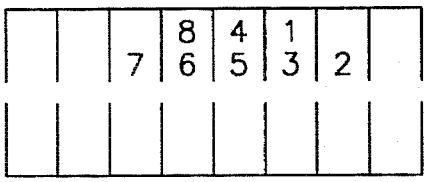
Figures 2, 3F:
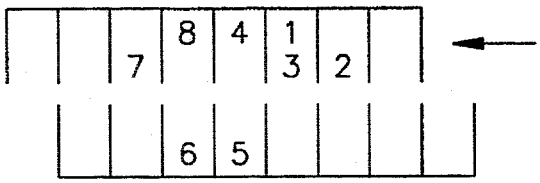
Figures 3, 3F:
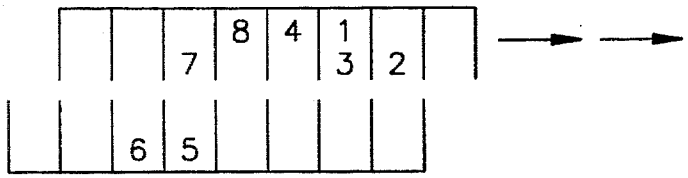
Figures 3, 3F, 4:
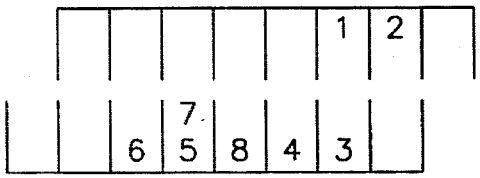
Figures 3, 3F, 4, 5:
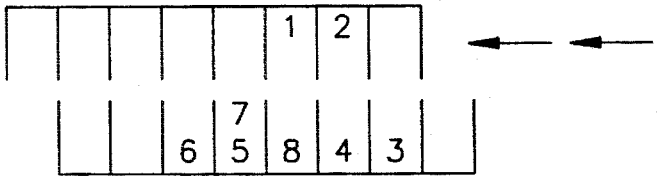
Figures 3, 3F, 4, 5, 6:
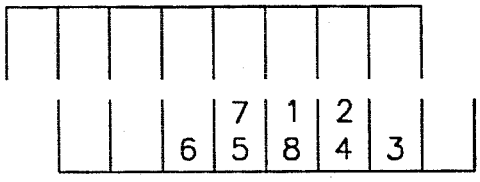
Figures 3, 3F, 4, 5, 6, 7:
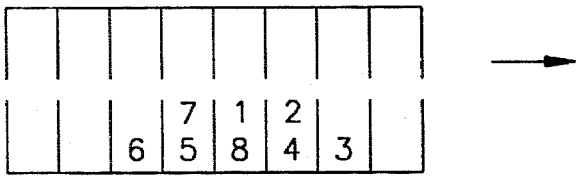
Figures 1, 3G:
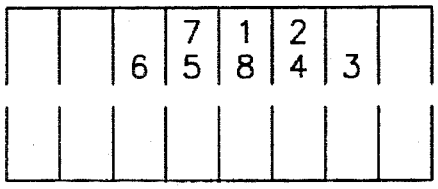
Figures 2, 3G:
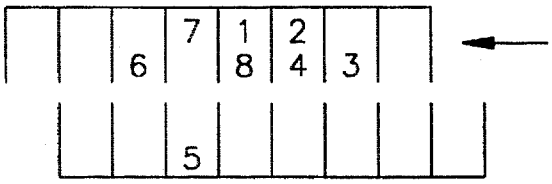
Figures 3, 3G:
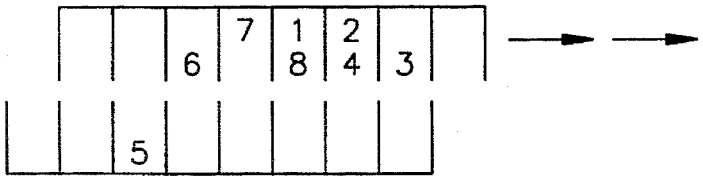
Figures 3, 3G, 4:
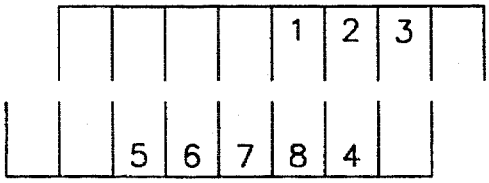
Figures 3, 3G, 4, 5:
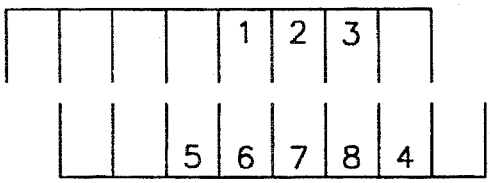
Figures 3, 3G, 4, 5, 6:
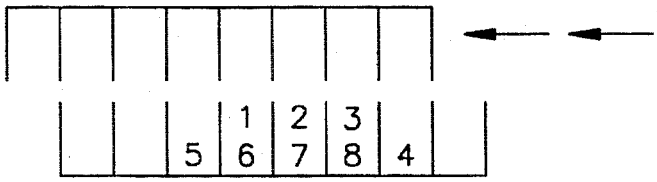
Figures 3, 3G, 4, 5, 6, 7:
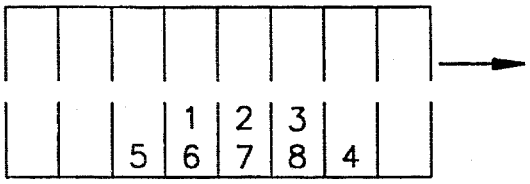

Three further return transfer steps are then carried out as illustrated in FIGS. 3F(i) to FIG. 3F(vii); FIG. 3G(i) to FIG. 3G(vii); and FIG. 3H(i) to FIG. 3H(vii), with each successive yarn arriving at the last opening being transferred in the same manner as yarn 1 in the transfer step described with FIG. 3E(i) to FIG. 3E(vii). As will be seen from FIG. 3H(vii) all the yarns 1 to 8 are in the configuration in which they appeared at the commencement of the first forward transfer step illustrated in FIG. 3A(i).

The succession of forward transfer steps followed by the succession of return transfer steps is then repeated.

In the continuous production of the yarn structure 10, each of the yarn transfer steps described with reference to FIGS. 3A(i) to 3H(viii) is a first in a succession of steps in each cycle of operation of the machine illustrated in FIG. 2A. One cycle of operation of the machine including a single transfer step and the remaining steps of the cycle will now be described with reference to FIG. 4(i) to FIG. 4(viii).

Referring first to FIG. 4(i) the yarn structure 10 shown is in the process of being formed from the two non woven inclined bias yarns 11 and 12, the binding warp yarns 13 and the upper and lower weft yarns 14 and 15. The binding warp yarn needle 26 is in its retracted position as shown, The beater 30 is also in its retracted position. The yarns 11 and 12 leaving the yarn guide member 21 have just been displaced by the bias yarn transfer mechanism 18 one yarn transfer step as described for example with reference to FIG. 3A(i) to 3A(vii) as a consequence of which they take up paths to the formed structure 10 which are inclined to the warp direction and to each other and cross-over at an intermediate cross-over position between the yarn transfer mechanism 18 and the formed yarn structure 10.

A binding wary yarn insertion step follows the bias yarn transfer step and is illustrated in FIG. 4(ii). As shown the insertion needle 26 passes through the two non-woven The bias yarn transfer step, for example as illustrated in FIGS. 3A(i) to 3A(vii), is followed by a binding warp yarn insertion step as illustrated in FIG. 4(ii) and second yarn portions 31 and 32. As shown, needle insertion is arranged on the creel side of the cross over portion of the yarns 11 and 12 so that the binding warp yarn portion 31 displaces the cross over portion of the yarns 11 and 12 in the direction of the structure 10 being formed.

The next succeeding step in the cycle of operation is illustrated in FIG. 4(iii) and is a weft yarn insertion step in which the weft yarn insertion station 23 inserts a weft yarn 15 on the creel side of the portion 31 of the binding warp yarn 13. This weft yarn insertion step is then followed by a beating up step using the beater 30 as illustrated in FIG. 4(iv) which brings the newly inserted weft yarn 15 into position against the the structure 10 and forms an upper binding loop portion 131.

The beater 30 is then retracted and the binding warp yarn needle 26 is returned to its retracted position as illustrated in FIG. 4(v). The needle retraction step is then followed by a further weft yarn insertion step in which the weft yarn insertion station 23 inserts a weft yarn 14 at a position on the creel side of the binding warp yarn 13 as illustrated in FIG. 4(vi). This weft insertion step is then followed by a further beating up step carried out by the beater 30 as illustrated in FIG. 4(vii). Finally, the beater 30 is retracted to the (vii) which brings the newly inserted weft yarn 14 into position against the structure 10 and forms a lower binding loop portion 132 of steps in a complete cycle of operation of the machine.

It will be appreciated that the yarn engaging elements 19 of the jacquard mechanism 20 have for the formation of the structure 10 of FIG. 1A been used only for shedding the warp sheet 17 to provide for transfer of the yarns 11 and 12 and that any other form of shedding mechanism could be employed for this simple task in place of jacquard mechanism 20.

It will also be appreciated that a need for continually engaging and disengaging warp yarns of the warp sheet 17 with and from the yarn engaging elements 19 of the jacquard mechanism 20 does not arise in the formation of the yarn structure 10 illustrated in FIG. 1A and produced on the machine shown in FIG. 2A. The structure 10 may however be found to have insufficient stability as there will be a tendency for the structure to reduce in width with the yarns 11 and 12 of the non-woven yarn assemblies tending to straighten, but nevertheless the three dimensional structure thus formed could find application in a composite where a deformable preform is an advantage.

With the aim of increasing the stability of the three dimensional yarn structure, the weft yarns 15 of the structure 10 illustrated in FIG. 1A can conveniently form part of a woven yarn assembly as now to be described with reference to FIG. 1B.

Figure 1B:
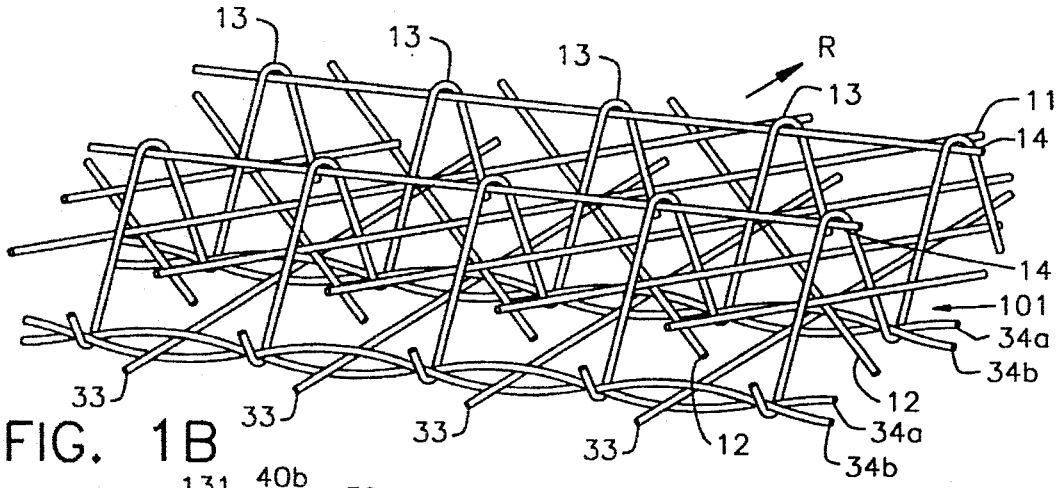

Referring now to FIG. 1B, the structure 101 includes the two non-woven superposed sub-assemblies of warp yarns 11 and 12, the binding warp yarns 13 and upper weft yarns 14 arranged and interlaced with each other in the same manner as the corresponding yarns in the structure 10. The lower assembly of weft yarns are however replaced by a woven yarn assembly which comprises warp yarns 33 and holding weft yarns **34*a* and 34*b* which are woven in plain weave pattern with the warp yarns 33 and which at the same time serve to hold the binding warp yarns 13 captive at the lower face of the yarn structure 101**.

Figure 2B:
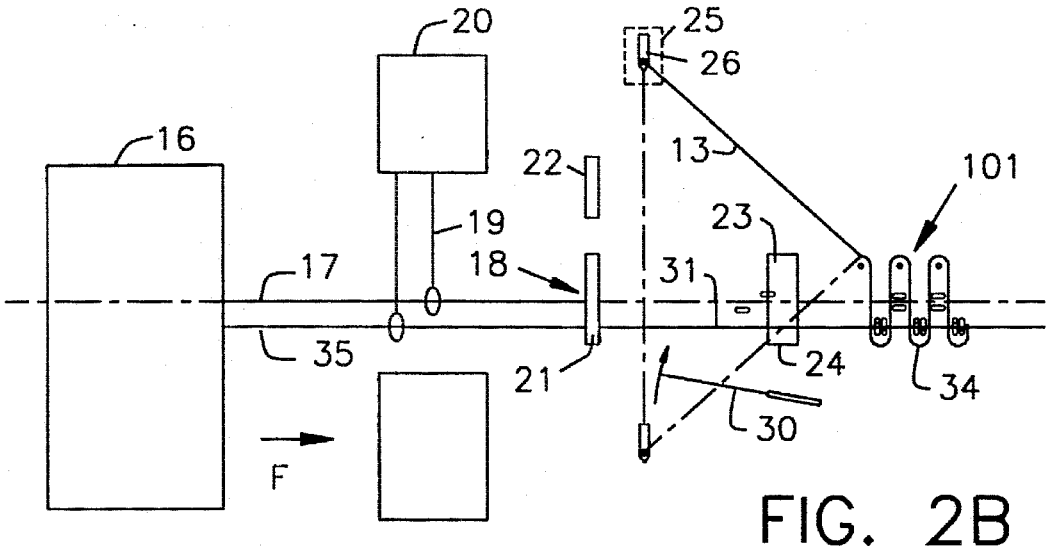

Referring now to FIG. 2B, a machine for producing the structure 101 is shown and includes all the components of the machine described with reference to FIG. 2A, except that the creel 16 is arranged to supply in the form of a warp sheet 35 the further warp yarns 33 and further yarn engaging elements 36 of the jacquard mechanism 20 are arranged to engage these warp yarns which are fed via the yarn transfer mechanism 18 for processing in a manner hereinafter to be described.

The structure 101 is produced on the machine illustrated in FIG. 2B with the same sequence of steps in successive cycles of operation as that described with reference to FIG.

4(i) to FIG. 4(viii) except insofar as the weft yarn insertion of the weft yarns 34*a* and 34*b* needs to be made after appropriate shedding of the warp yarns 33 of the warp sheet 35 by the controlled raising of the yarn engaging elements 36 of the mechanism 20, as now to be described with reference to FIGS. 5(i) to FIG. 5(viii).

Referring now to FIG. 5(i) the yarn structure 101 is in the process of being formed from the two non-woven sub-assemblies of yarns 11 and 12, the binding warp yarns 13, the upper weft yarns 14, the warp yarns 33 of the warp sheet 35 and the woven holding weft yarns 34*a* and 34*b*. The binding warp yarn needle 26 is in its retracted position, the beater 30 is also in its retracted position and the yarns 11 and 12 leaving the yarn guide member 2 have just been displaced by the yarn transfer mechanism 18.

A binding warp yarn insertion step follows the yarn transfer step and is illustrated in FIG. 5(ii). As shown, the insertion needle 26 passes through the non-woven warp yarn assembly formed by the yarns 11 and 12, drawing with it the binding warp yarn 13 to form first and second yarn portions 31 and 32. As before, needle insertion is arranged on the creel side of the cross-over portion of the yarns 11 and 12 so that the binding warp yarn portion 31 displaces the cross-over portion of the yarns 11 and 12 in the direction of the structure 101 being formed.

The next succeeding step in the cycle of operation is illustrated in FIG. 5(iii) which is a weft yarn insertion step. In this step the yarn engaging elements 36 of the jacquard mechanism 20 are selectively raised to form a raised shed composed of an upper array $\mathbf{33}^{1}$ of warp yarns selected as alternate warp yarns of the warp sheet 35 and a lower warp yarn array $\mathbf{33}^{11}$ representing the remaining alternate warp yarns of the warp sheet 35. With the yarns of the warp sheet 35 thus shed the weft yarn insertion station 23 inserts a weft yarn 34*a* within the shed as shown. The upper array $\mathbf{33}^{1}$ is then lowered to the level of the warp sheet 35 and following a beating up step (not illustrated) by the beater 30 the lower warp yarn array $\mathbf{33}^{11}$ is raised and a weft yarn 34*b* inserted in the shed thus formed. The yarns of the array $\mathbf{33}^{11}$ are then lowered to the level of the warp sheet 35 as illustrated in FIG. 5(iv) to produce a woven weft yarn configuration 38. This weft yarn insertion step is then followed by a beating up step using the beater 30 as illustrated in FIG. 5(v), which brings the newly inserted weft yarns 34*a* and 34*b* into position against the structure 101.

The beater 30 is then retracted and the binding warp yarn needle 26 is returned to its retracted position as illustrated in FIG. 5(vi). The needle retraction step is then followed by a weft insertion step in which the weft yarn insertion station 23 inserts a holding weft yarn 14 at a position on the creel side of the binding warp yarn 13 as illustrated in FIG. 5(vii). This weft insertion step is then followed by a further beating up step carried out by the heater 30 as illustrated in FIG. 5(viii). Finally, the beater 30 is retracted to the position shown in FIG. 5(i) to complete the sequence of steps in a complete cycle of operation of the machine illustrated in FIG. 2B.

It will again be appreciated that the yarn engaging elements 19 and 36 of the jacquard mechanism 20, have for the formation of the structure 101 of FIG. 1B, been used only for (i) shedding the warp sheet 17 to provide for transfer of the bias yarns 11 and 12 and (ii) shedding of the warp sheet 35 to provide for insertion of the weft yarns 34*a* and 34*b* for the lower woven yarn assembly.

With the aim of increasing still further the stability of the three-dimensional yarn structure, the weft yarns 14 of the structure 101 illustrated in FIG. 1B can conveniently also form part of a woven yarn assembly as now to be described with reference to FIG. 1C.

Figure 1C:
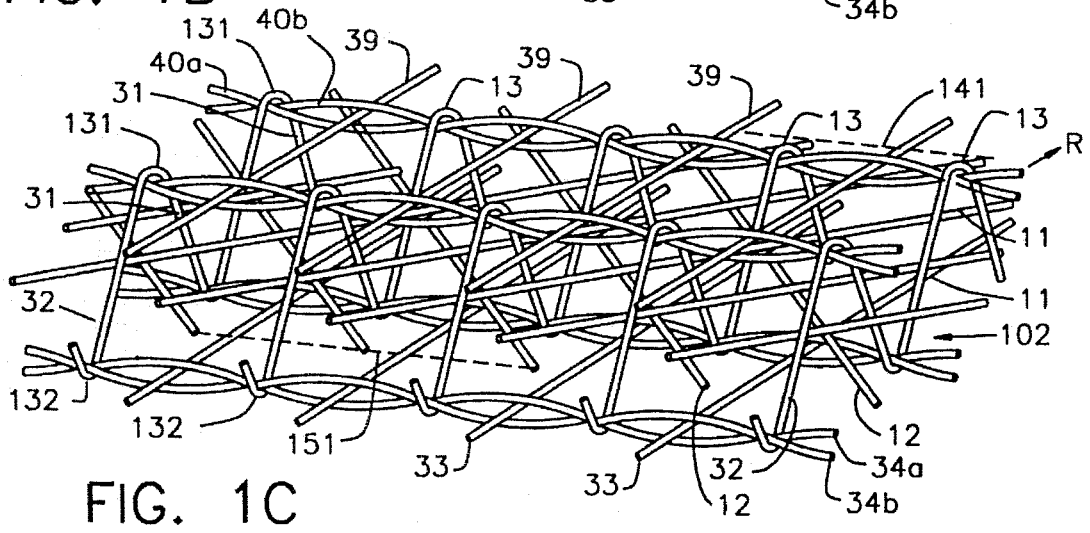

Referring now to FIG. 1C, the structure 102 includes the two non-woven superposed sub-assemblies of bias yarns 11 and 12 the binding warp yarns 13 and the lower woven yarn assembly comprising the warp yarns 33 and the holding weft yarns 34*a* and 34*b* which are woven in plain weave pattern as hereinbefore described with reference to FIGS. 5(i) to 5(viii). The upper assembly of weft yarns 14 of the structure 101 are however replaced by a further woven yarn assembly which comprises warp yarns 39 and holding weft yarns 40*a* and 40*b* which are woven in plain weave pattern with the warp yarns 39 and which at the same time serve to hold the binding warp yarns 13 captive at the upper face of the yarn structure 102.

Figure 2C:
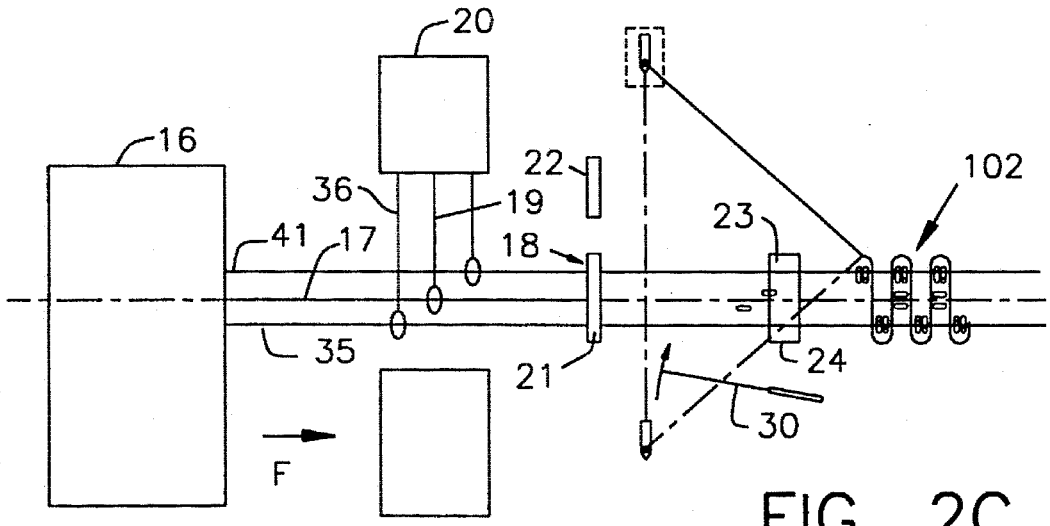

Referring now to FIG. 2C, a machine for producing the structure 102 is shown and includes all the components of the machine described with reference to FIG. 2B, except that the creel 16 is arranged to supply in the form of a warp sheet 41 the further warp yarns 39 and further yarn engaging elements 42 of the jacquard mechanism 20 are arranged to engage these warp yarns which are fed via the yarn transfer mechanism 18 for processing as hereinafter to be described.

The structure 102 is produced on the machine illustrated in FIG. 2C with the same sequence of steps in successive cycles of operation as that described with reference to FIG. 5(i) to FIG. 5(viii) except insofar as the weft yarn insertion of the weft yarns 40*a* and 40*b* needs to be made after appropriate shedding of the warp yarns 39 of the warp sheet 41 by the controlled raising of the yarn engaging elements 42 of the mechanism 20 as now to be described with reference to FIGS. 6(i) to FIG. 6(x).

Referring now to FIG. 6(i) the yarn structure 102 is in the process of being formed from the two non-woven arrays of bias yarns 11 and 12, the binding warp yarns 13, the warp yarns 33 of the warp sheet 25 with the woven holding weft yarns 34*a* and 34*b* and the warp yarns 39 of the upper warp sheet 41 with the woven holding weft yarns 40*a* and 40*b*. The binding warp yarn needle 26 is in its retracted position, the beater 30 is also in its retracted position and the yarns 11 and 12 leaving the yarn guide member 21 have just been displaced by the yarn transfer mechanism 18.

A binding warp yarn insertion step follows the warp yarn transfer step and is illustrated in FIG. 6(ii). This warp yarn insertion step corresponds to that described with reference to FIG. 5(ii) and is followed by a weft yarn insertion step as illustrated in FIG. 6(iii). In this step, and as previously described, the yarn engaging elements 36 of the jacquard mechanism 20 are selectively raised to form a raised shed composed an upper array $\mathbf{33}^{1}$ of warp yarns selected as alternate warp yarns of the warp sheet 35 and a lower warp yarn array $\mathbf{33}^{11}$ representing the remaining alternate warp yarns 33 of the warp sheet 35. With the yarns 33 of the warp sheet 35 thus shed, the weft insertion station 23 inserts a weft yarn 34*a* within the shed as shown. The upper array $\mathbf{33}^{1}$ is then lowered to the level of the warp sheet 35 and following a beating up step (not illustrated) by the beater 30 the lower warp yarn array $\mathbf{33}^{11}$ is raised and a weft yarn 34*b* inserted in the shed thus formed. The yarns of the array $\mathbf{33}^{11}$ are then lowered to the level of the warp sheet 35 as illustrated in FIG. 6(iv) to produce the lower woven weft yarn configuration 38. This weft insertion step is then followed by a beating up step using the beater 30 as illustrated in FIG. 6(v), which brings the newly inserted weft yarns 34*a* and 34*b* into position against the structure 102.

The beater 30 is then retracted and the binding warp yarn needle 26 is returned to its retracted position as illustrated in FIGS. 6(vi). The needle retraction step is then followed by a weft yarn insertion step as illustrated in FIG. 6(vii). In this step, the yarn engaging elements 42 of the jacquard mechanism 20 are selectively raised to form a raised shed composed of an upper array $39^{1}$ of warp yarns selected as alternate warp yarns of the warp sheet 41 and a lower warp yarn array $39^{11}$ representing the remaining alternate warp yarns 29 of the warp sheet 41. With the yarns 39 of the warp sheet 41 thus shed, the weft yarn insertion station 23 inserts, a weft yarn 40*a* within the shed as shown. The upper array $39^{1}$ is then lowered to the level of the warp sheet 41 and the lower warp yarn array $39^{11}$ raised and a weft yarn 40*b* inserted in the shed thus formed. The yarns of the array $39^{11}$ are then lowered to the level of the warp sheet 41 as illustrated in FIG. 6(viii) to produce a woven weft yarn configuration 44. The weft yarn insertion step is then followed a final beating up step as illustrated in FIG. 6(ix) which brings the newly inserted weft yarns 39*a* and 39*b* into position against the structure 102. Finally the beater 30 is retracted to the position shown in FIG. 6(x) to complete the sequence of steps in the complete cycle of operation of the machine illustrated in FIG. 2C.

To facilitate the description, the machines in FIGS. 2B and 2C have been regarded as modifications of the machine shown in FIG. 2A. In practice, one machine would of course be used and appropriate changes made to the supply of warp yarns from the creel 16 and the passage of the warp yarn through appropriate ones of the yarn guide elements of the jacquard mechanism 20.

The yarn transfer steps described with reference to FIG. 3A(i) to FIG. 3A(vii) is only one example of a variety of ways in which the warp yarns of the warp sheet 17 can be formed into diagonal ±45° non-woven warp yarn sub-assemblies. If desired, yarn transfer may alternatively be carried out by reversing the sequence of steps described with reference to FIGS. 3A(i) to 3A(vii) that is to say, to commence with the return yarn transfer steps and follow these with the forward yarn transfer steps. Further modifications of these yarn transfer steps can of course be made provided that the yarns progress along a non-intersecting path first in one direction until the order of the yarns in the yarn guide member 21 is reversed and then in the opposite direction until the yarns return to their original order in the yarn guide member 21.

The weft insertion station 23 has been shown schematically to aid description of weft yarn insertion and it is to be understood that weft insertion would be carried out using in the machine either a single rapier or needle or two rapiers or needles at the same height.

Referring now to FIG. 7, the machine shown corresponds to that illustrated in FIG. 2C and operates in the manner hereinbefore described with reference to FIG. 2C. It includes the jacquard mechanism 20 which performs the required shedding of the warp yarns that are engaged by it under the control of a drive control unit 42 which also serves to provide drive signals for a drive mechanism 43 for driving the yarn transfer member 22 through its transfer movements in phased relation to the shedding of the yarns of the warp sheet 17 under the control of the jacquard mechanism 20. The drive control unit 42 also provides drive signals for driving the binding warp yarn insertion mechanism 25 for insertion of the binding warp yarn insertion needle 26 at the appropriate times in each cycle of operation as hereinbefore described. In addition, the drive control unit 42 provides drive signals for application to the weft insertion mechanism 23 to activate it at the appropriate times in the cycle of operation as hereinbefore described.

It will be appreciated that the jacquard mechanism 20, the binding warp yarn insertion mechanism 25 and the weft insertion mechanism 23 are all mechanisms well known to those versed in the art and may take well known forms.

The layout of the yarn support elements 19 in the jacquard mechanism 20 needs to be made such that the yarns from the yarn support elements 19 are given a clear line of sight to each of the guide openings 27 and to each of the transfer openings 29 of the yarn transfer mechanism 18.

In the machine hereinbefore described with reference to the drawings a yarn support element is used for each yarn. It may however be possible to reduce the number of support elements used by having more than one yarn per support element, for example, in circumstances where a number of yarns are behaving in a similar manner.

A clear line of sight for the yarns can be obtained by so arranging the support elements 19 that they lie along the arc struck from the center of the transfer mechanism 18 and arranged symmetrically with respect to the mechanism 18. It will however be appreciated that yarns from the support elements at the ends of the arc will pass round the yarn guide elements 26, 27 with an angle of wrap which may be excessive and a different layout is therefore desirable.

Figures 1, 4A:
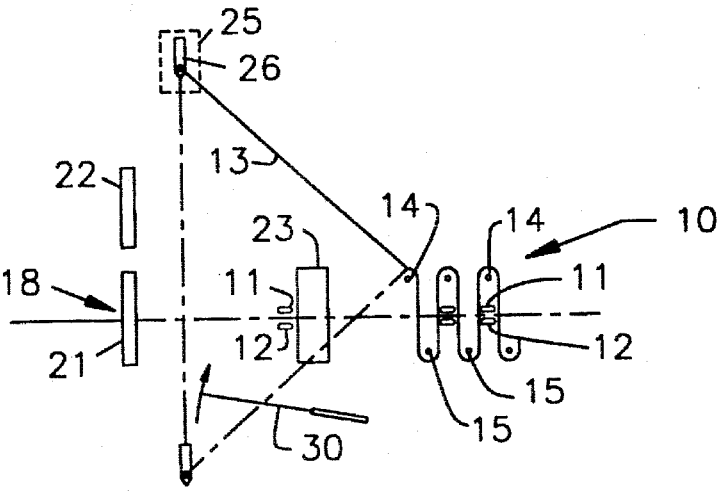
Figures 2, 4A:
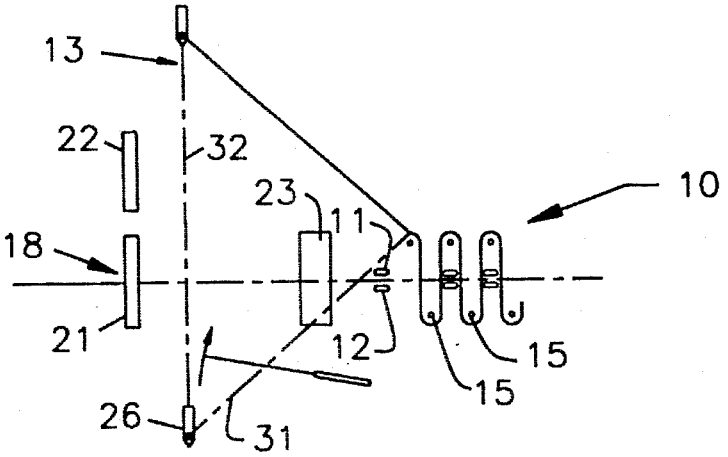
Figures 3, 4A:
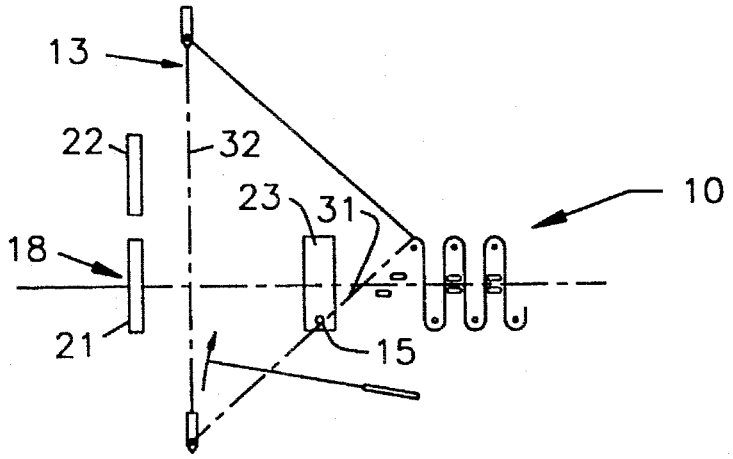
Figures 4, 4A:
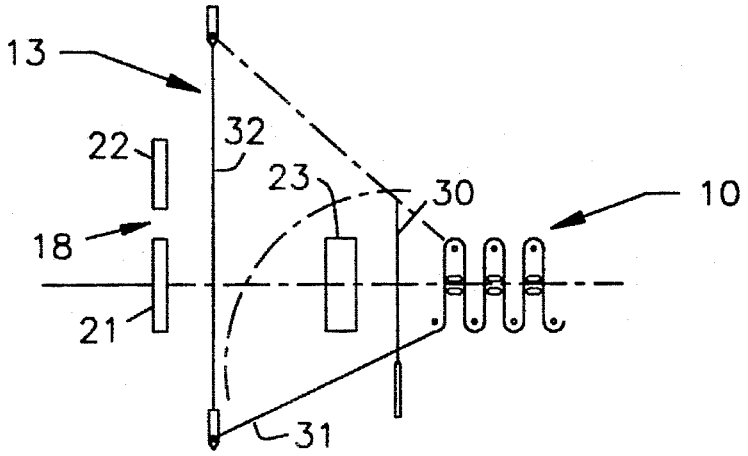
Figures 4, 4A, 5:
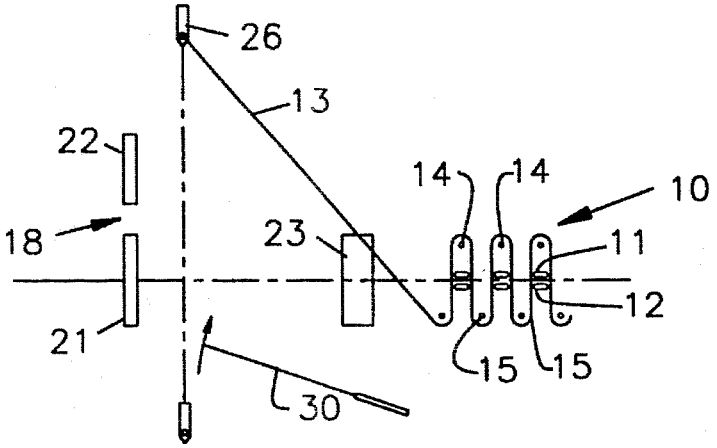
Figures 4, 4A, 5, 6:
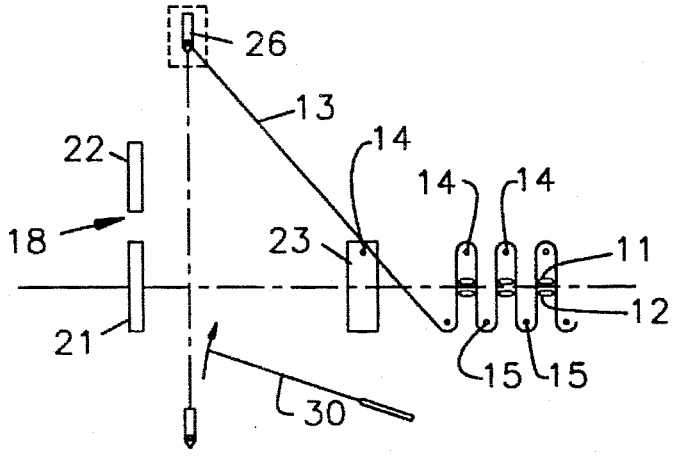
Figures 4, 4A, 5, 6, 7:
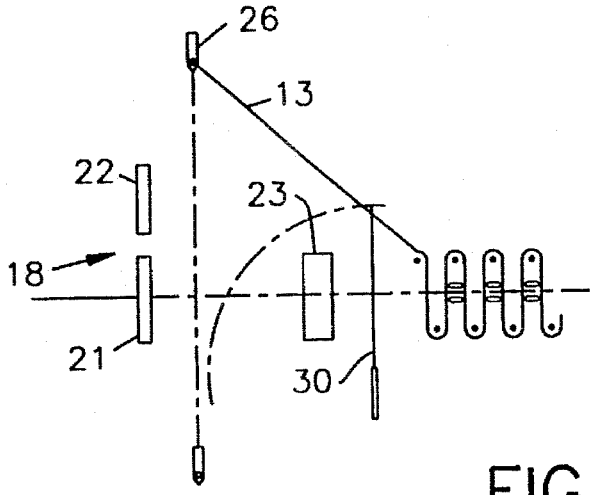
Figures 4, 4A, 5, 6, 7, 8:
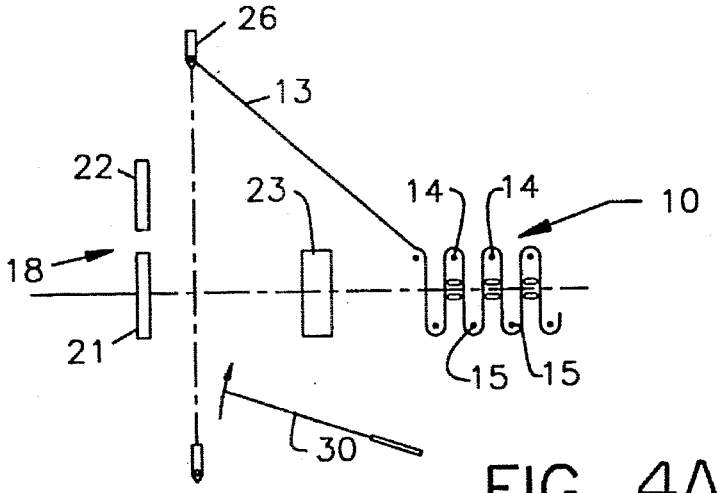
FIG. 8 is a schematic diagram of a layout in plan of yarn support elements of a jacquard mechanism used in supporting, shedding and guiding yarns in the machines illustrated in FIGS. 2A, 2B and 2C.
Figures 1, 5A:
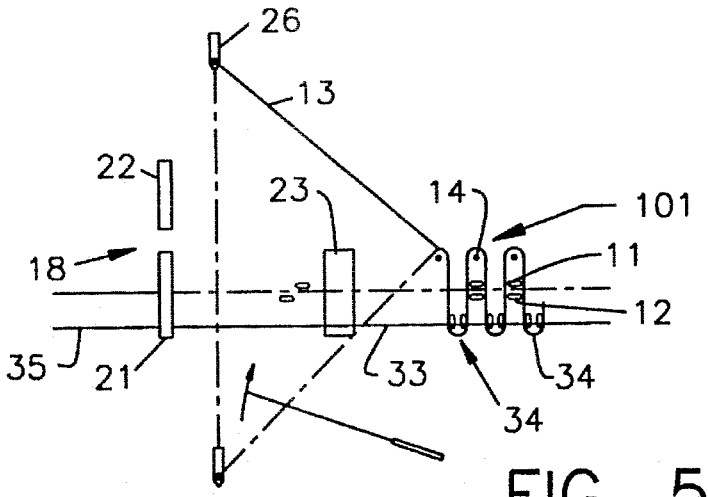
Figures 2, 5A:
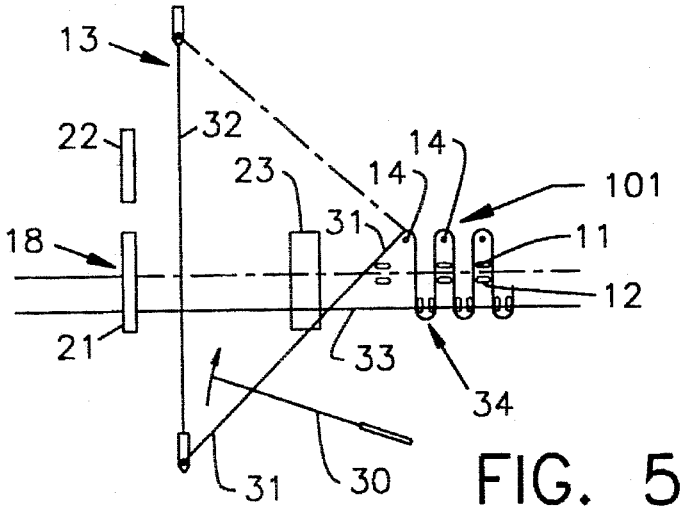
Figures 3, 5A:
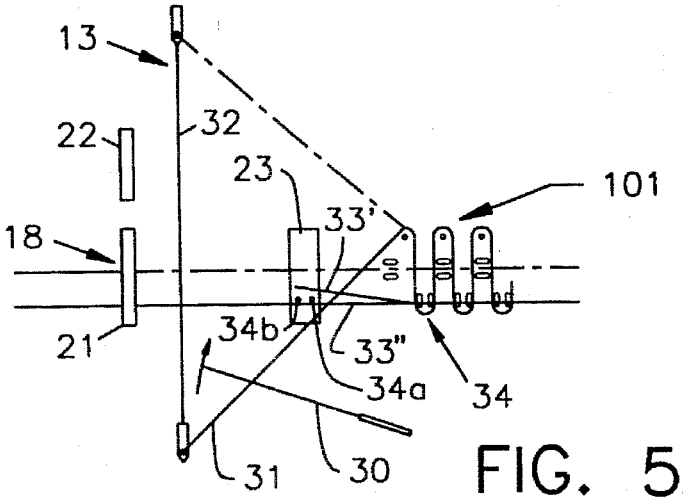
Figures 4, 5A:
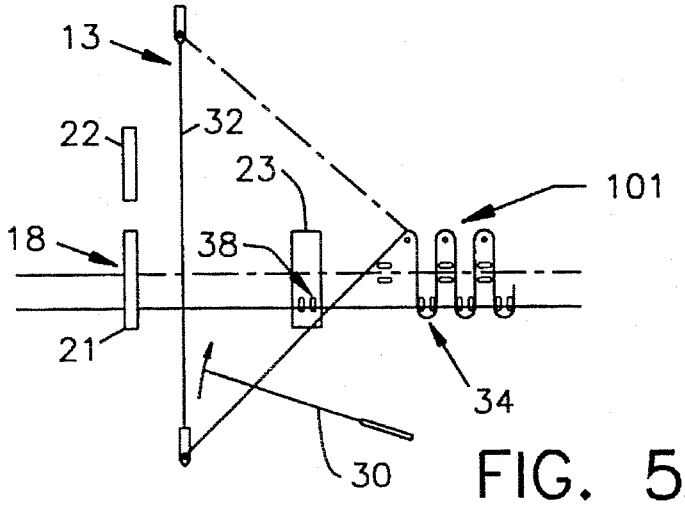
Figures 5, 5A:
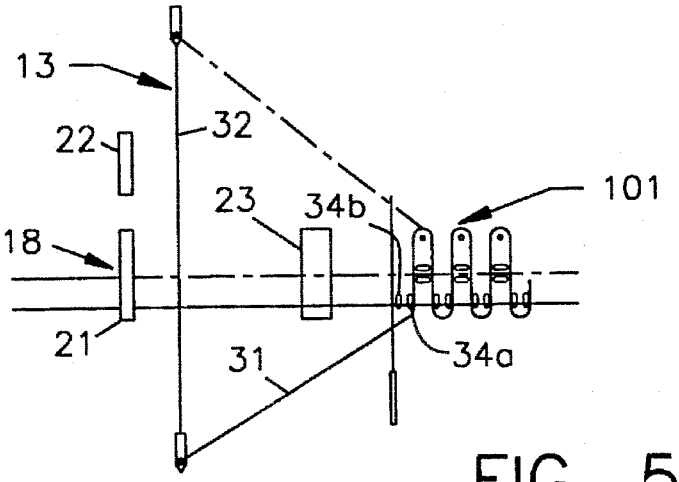
Figures 5, 5A, 6:
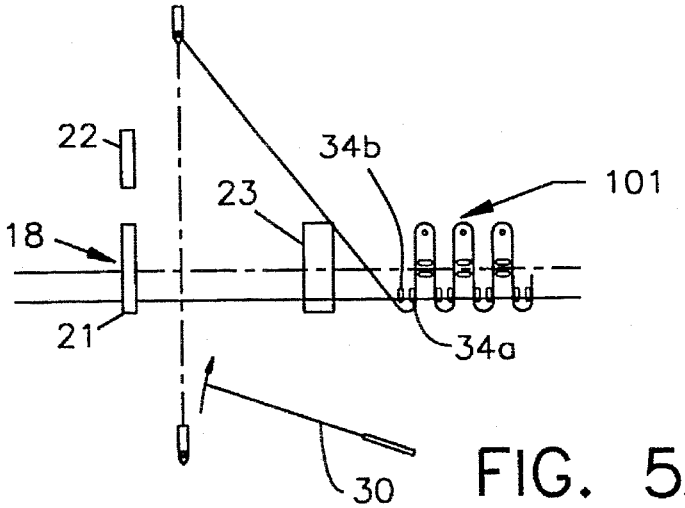
Figures 5, 5A, 6, 7:
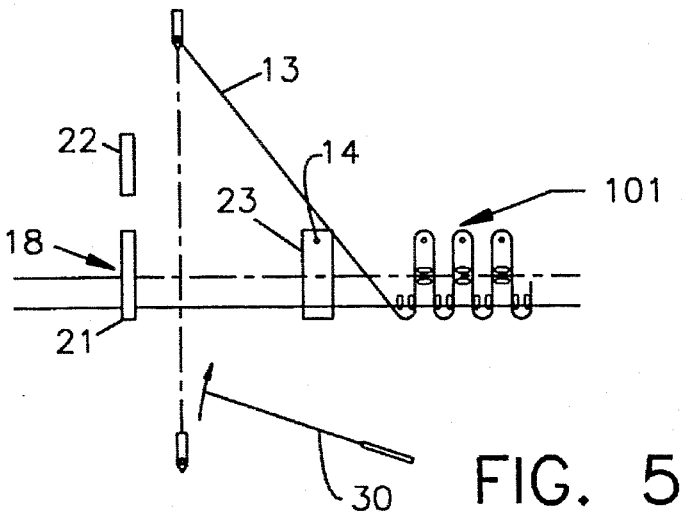
Figures 5, 5A, 6, 7, 8:
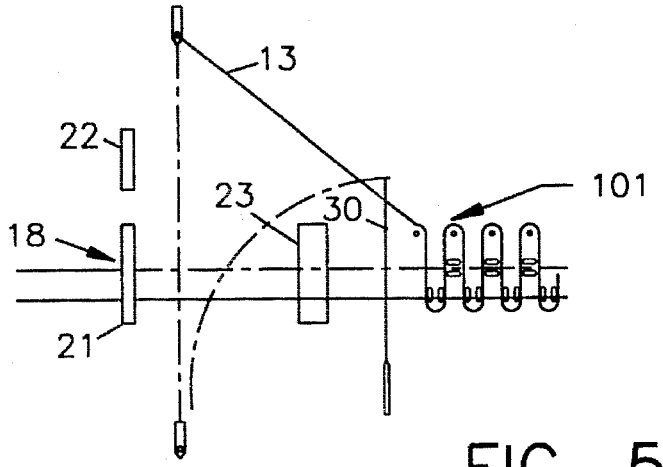

One suitable layout is shown in FIG. 8. Here the distance from the yarn transfer mechanism to the furthermost yarn support element 19 is fixed and in a specific example is 800 mm. The support elements 19 are laid out in 22 lines A, each of 72 yarn support elements 19, only six of which are shown in each line.

As shown in FIG. 8, the lines A are arranged in a zig-zag formation with the inner end of each line terminating at its intersection with an arc B struck from the center C of the yarn transfer mechanism 18 and at its other end at its intersection with an arc D also struck from the center C of the mechanism 18. In addition, at will be seen that a central pair of two innermost lines A are formed as a V configuration with one of them lying along a line from one end of the transfer mechanism 18 to its intersection with a perpendicular line E extending from the center C of the mechanism 18 and the other of them lying along a line from the other end of the mechanism 18 to its intersection with the perpendicular line E. A second pair of lines A forming a V configuration are formed on one side of the central pair of lines A by one of the lines A of the second pair extending from the innermost end of the adjacent line A of the central pair to the outer arc D along a line passing through one end of the transfer mechanism 18 while the other line A of the second pair extends from the outer end of the paired line A to the inner arc B along a line to the other end of the mechanism 18. A third pair of lines A are formed on the other side of the central pair in the same manner as the second pair and further pairs of lines A with V-configuration are built up in the same manner to form the zigzag array shown. With the array of elements 19 thus formed each element 19 will have the required clear line of sight over the full width of the transfer mechanism 18 as illustrated in FIG. 8 by yarn paths from the third innermost support element 19 of one of the lines A of the central pair and from the fourth innermost support element 19 of the other line A of the central pair.

It will be appreciated that the width of the array of lines A will be greater than the width of the transfer mechanism 18. In the case of a machine producing a narrow width yarn structure this may be acceptable particularly as it helps to separate the yarns and hence reduce yarn to yarn friction. It may however lead to an unacceptably large array of lines for production of a wide yarn structure or in machines designed to produce structures of a greater thickness. The width of the line array, and hence the greatest angle of wrap which the yarns have round the guide elements 26,28 of yarn guide and transfer members 21 and 22 can however be reduced by reducing the length of the lines A, that is to say, by reducing the spacing between adjacent support elements in each line A.

Figures 1, 3H:
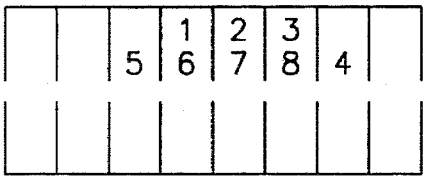
Figures 2, 3H:
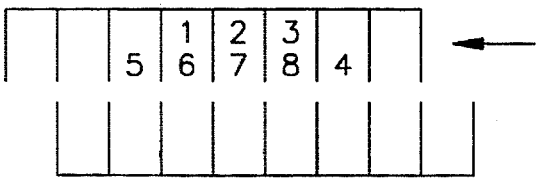
Figures 3, 3H:
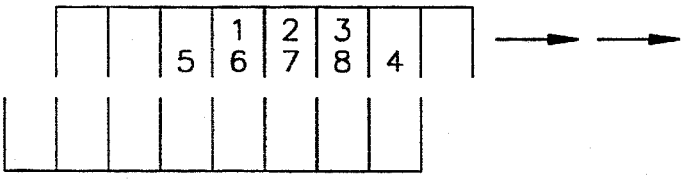
Figures 3, 3H, 4:
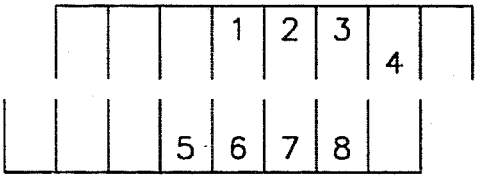
Figures 3, 3H, 4, 5:
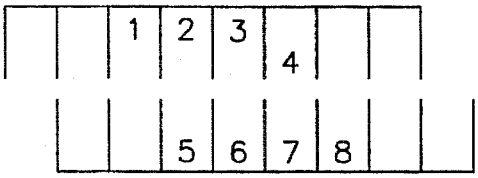
Figures 3, 3H, 4, 5, 6:
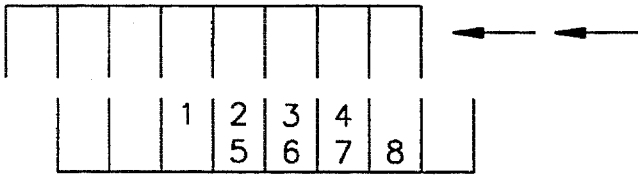
Figures 3, 3H, 4, 5, 6, 7:
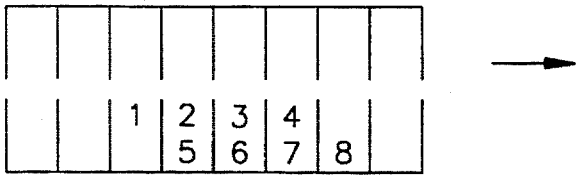

As to the yarn transfer drive mechanism 43, all that is required is a reciprocatory drive for the yarn transfer member 22 to cause displacements of it in the weft direction by the discrete amounts hereinbefore described with reference to FIG. 3A(i) to FIG. 3H(vii). Conveniently, the drive takes the form of a pneumatic piston and cylinder drive in which relative axial displacements of the piston and cylinder produce displacements of one opening and two openings of the yarn transfer member 22 as hereinabefore described.

It will be appreciated that the yarn structure forming machine illustrated in FIG. 7 can readily be programmed to produce any one of a wide variety of three dimensional yarn structures which include a bias yarn assembly composed of two bias yarn sub-assemblies in which the yarns of one sub-assembly are inclined to the yarns of the other sub-assembly and in which the bias yarns in each are inclined to the warp direction in the structure formed.

Figures 1, 6A:
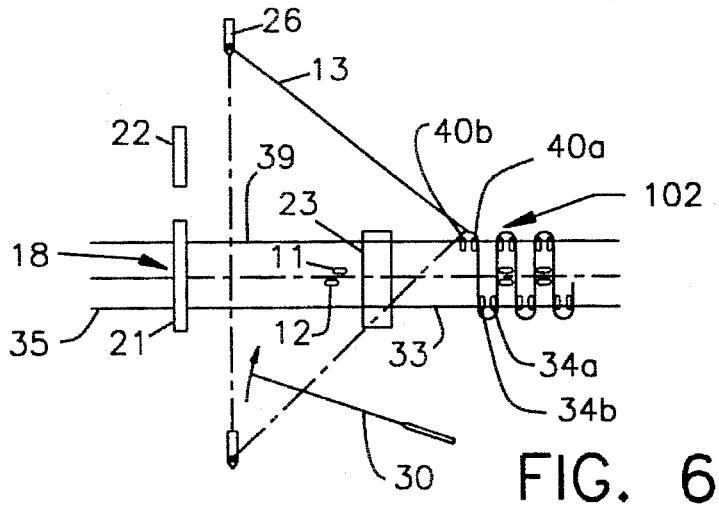
FIG. 6(i) to FIG. 6(x) are schematic diagrams illustrating successive steps in a complete cycle of operation of the machine illustrated in FIG. 2C for the production of the three-dimensional yarn structure illustrated in FIG. 1C.
Figures 2, 6A:
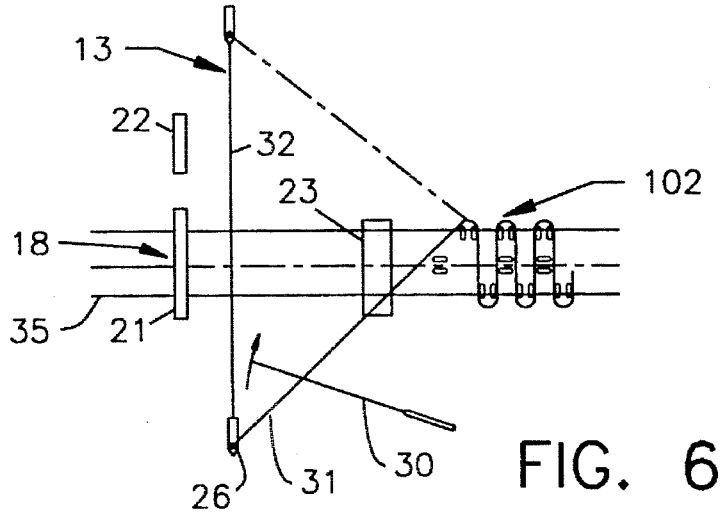
Figures 3, 6A:
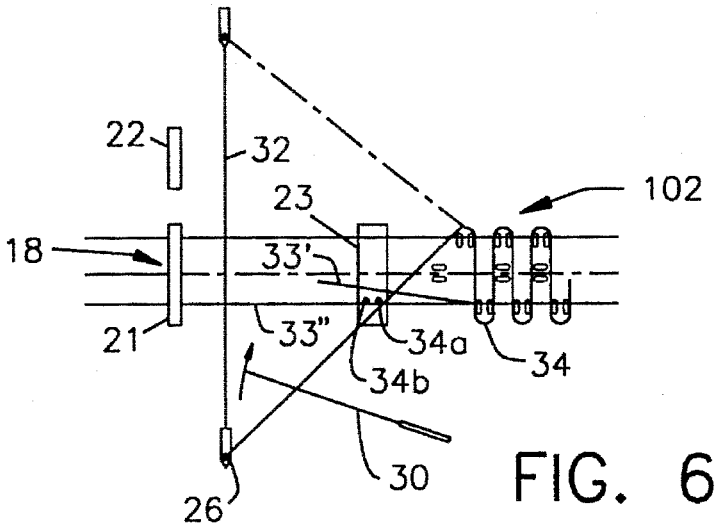
Figures 4, 6A:
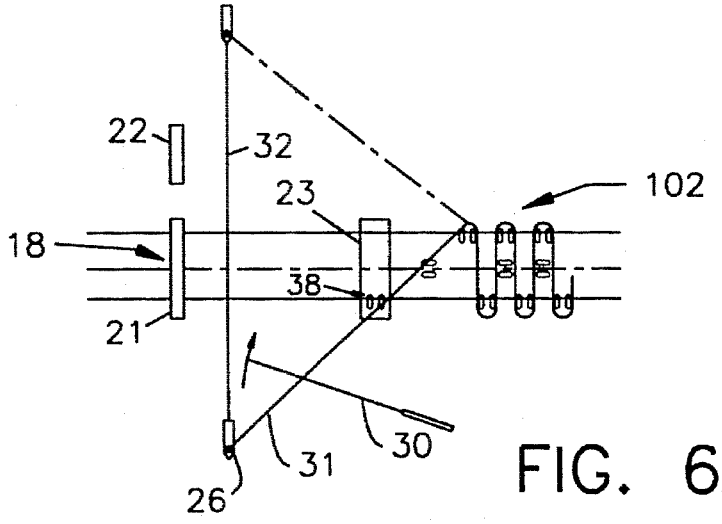
Figures 5, 6A:
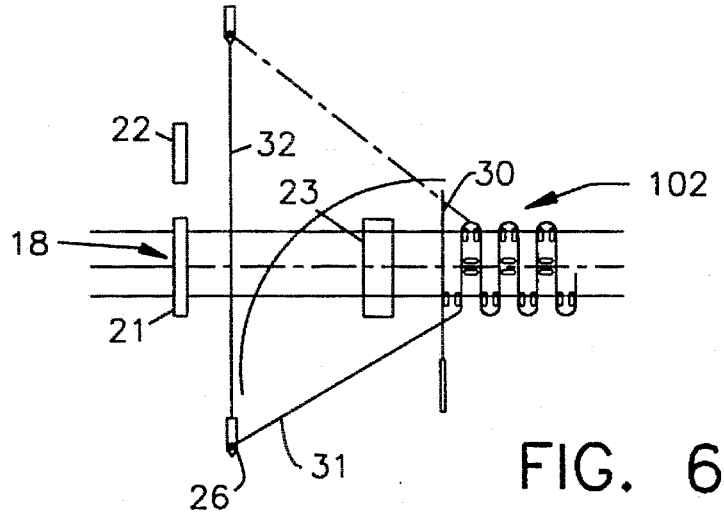
Figures 6, 6A:
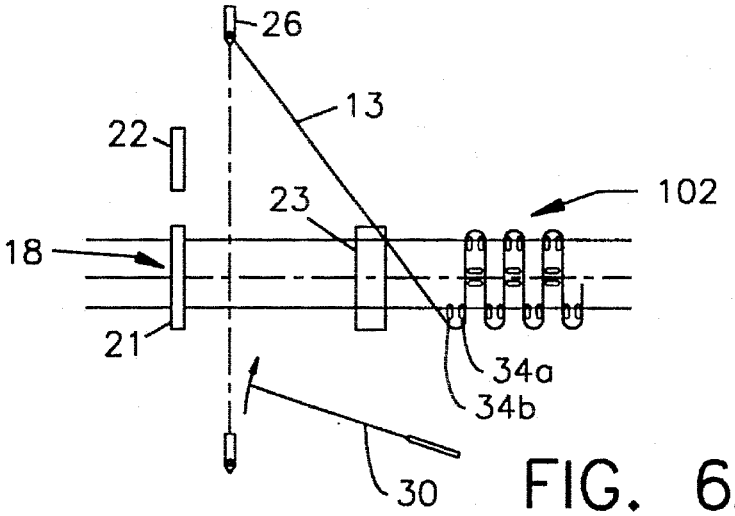
Figures 6, 6A, 7:
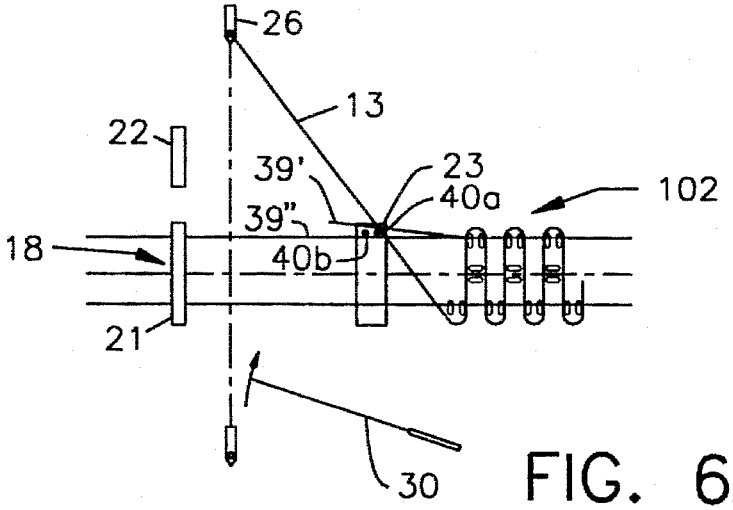
Figures 6, 6A, 7, 8:
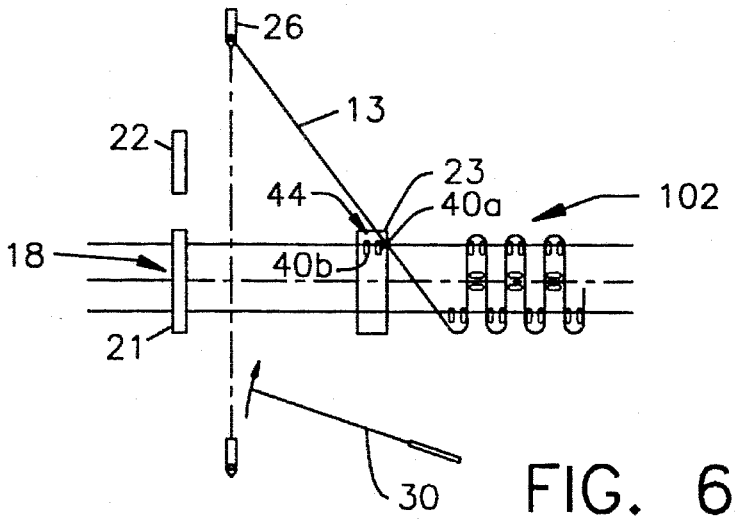
Figures 6, 6A, 7, 8, 9:
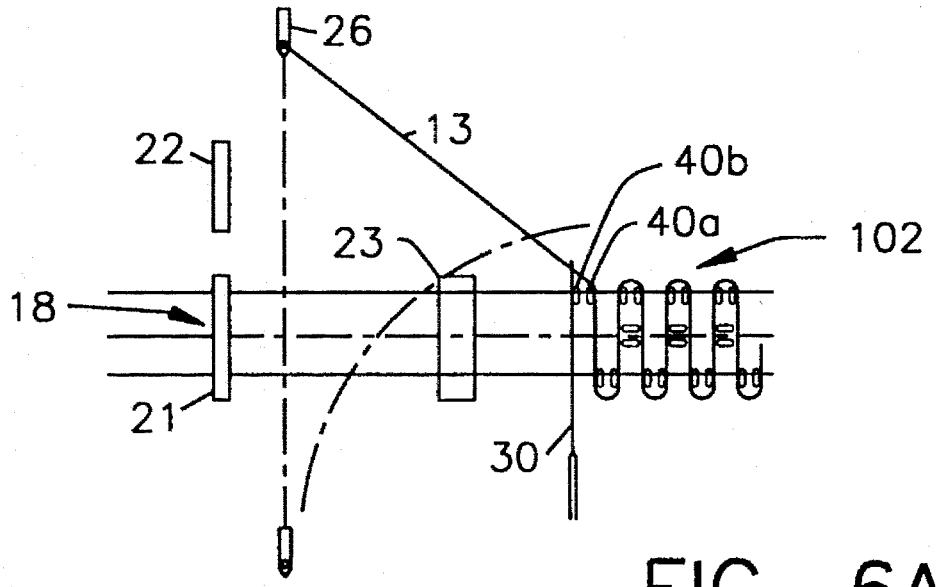
FIG. 9 is a schematic diagram of a yarn displacement mechanism for incorporation in the machines illustrated in FIGS. 2A, 2B and 2C, which provides for the formation of a modified yarn structure in accordance with the invention.
Figures 6, 6A, 7, 8, 9, 10:
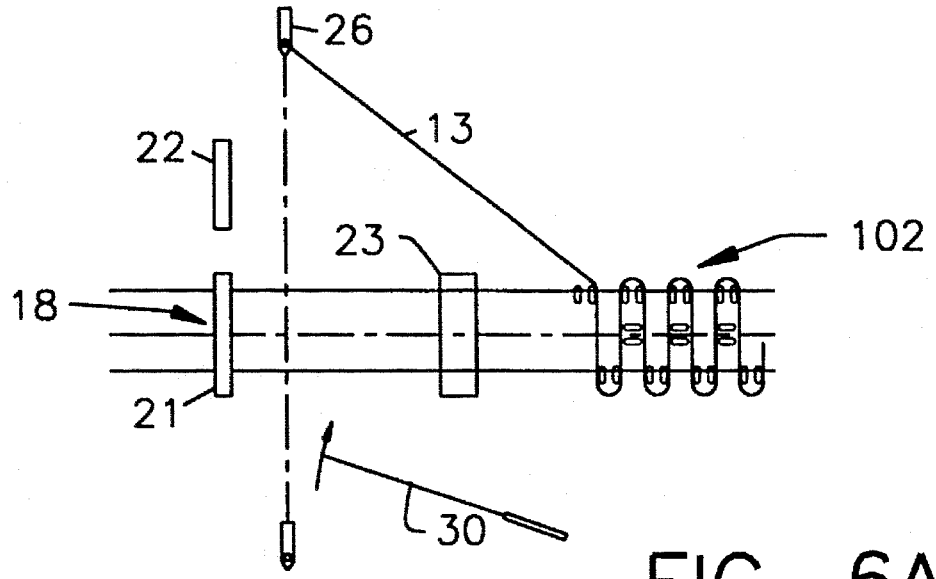
Figure 7:
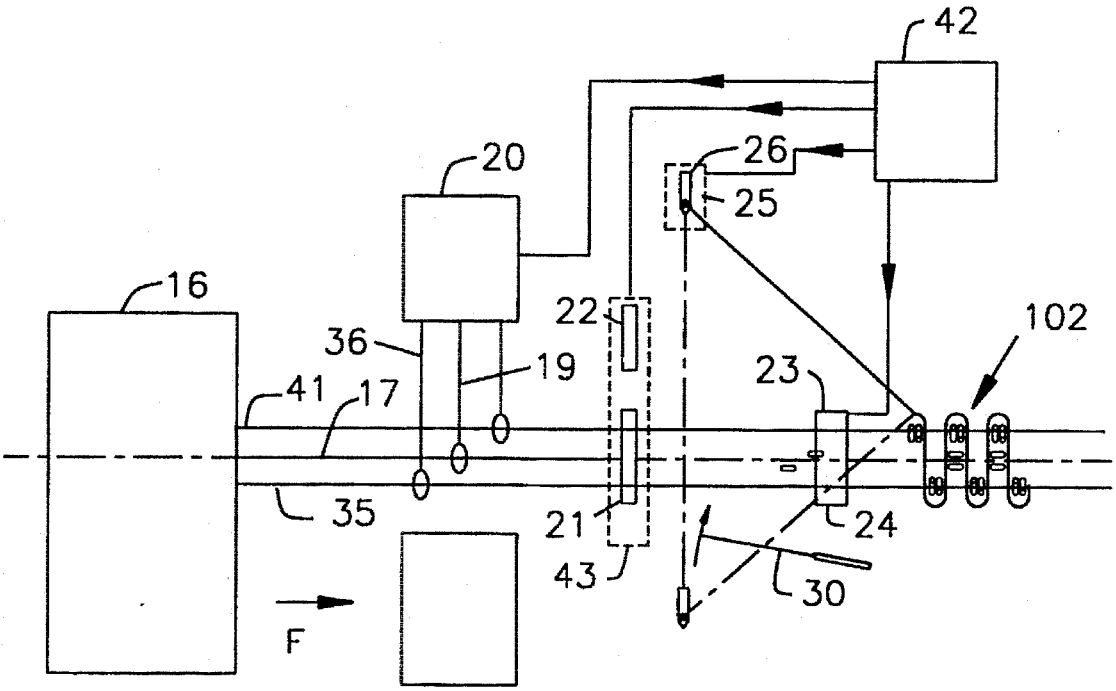
Figure 9:
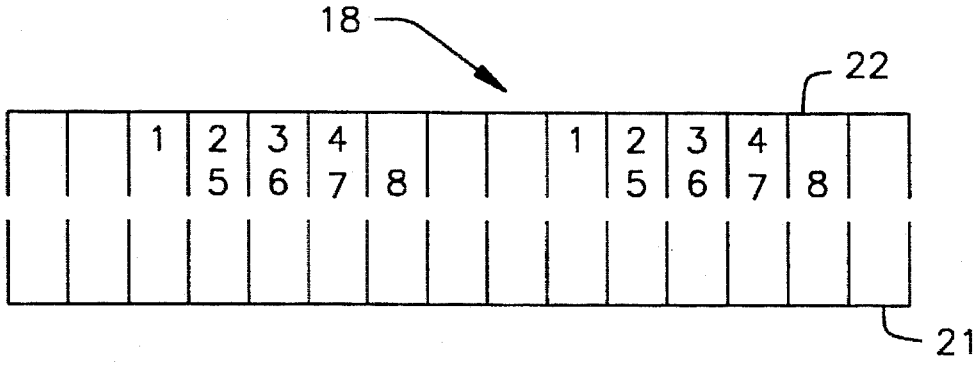
Figure 8:
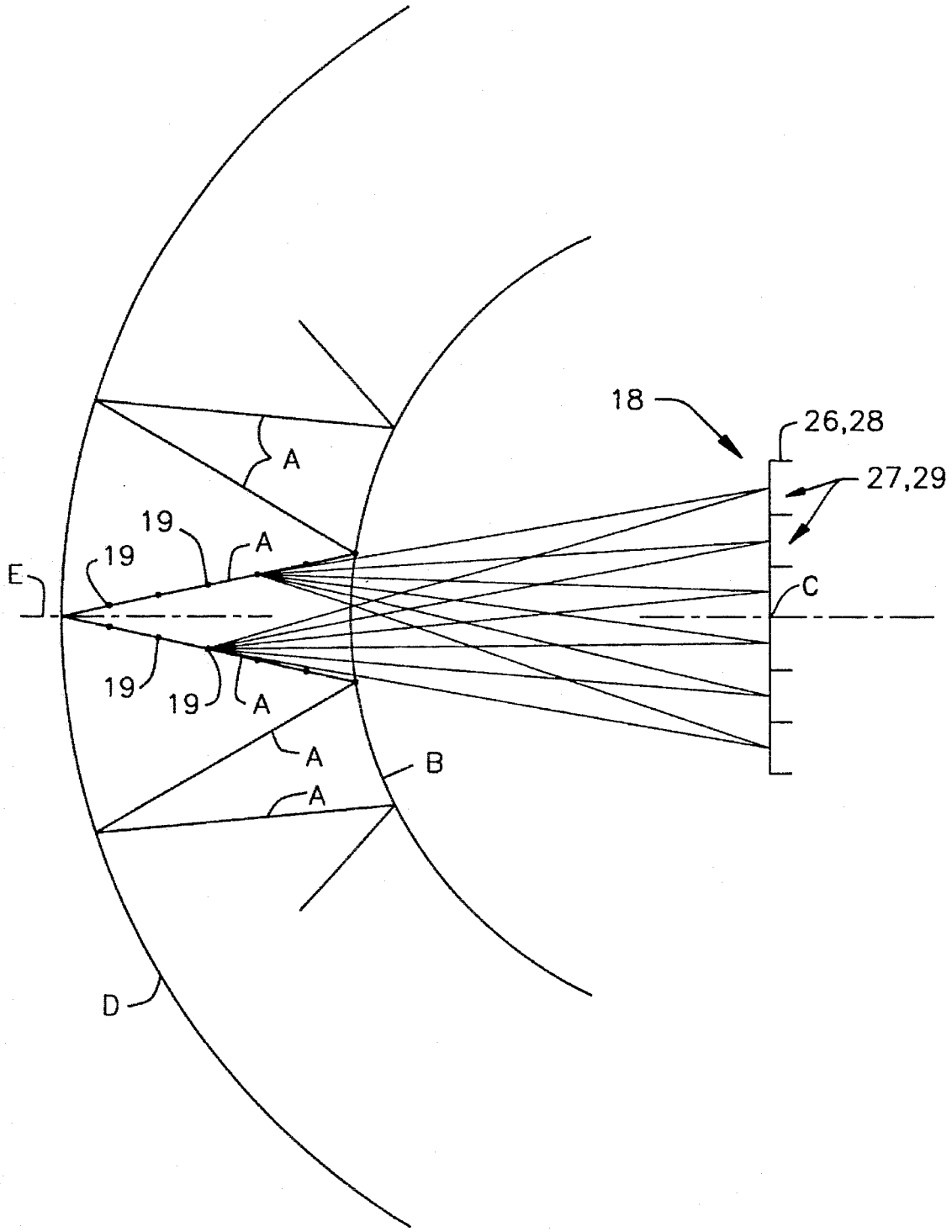

For example, as illustrated in FIG. 9, the yarn transfer mechanism is can be fed with yarns as illustrated to produce to non-overlapping bias yarn assemblies within the structure each of which includes two superposed non-woven bias yarn sub-assemblies produced as hereinbefore described with reference to FIG. 3A(i) to FIG. 3H(vii).

The structure formed is thus provided with spaced non-woven bias yarn assemblies which extend side by side lengthwise of the structure being formed with the portion containing one of the bias yarn assemblies being held to the portion containing the other bias yarn assembly by the weft yarns which extend throughout the full width of the yarn structure. The yarn structure thus formed can if desired be sub-divided along its length to produce separated half portions.

The versatility of the machine illustrated in FIG. 7 furthermore makes it possible to generate by appropriate programming of the drive control unit 42 three dimensional yarn structures having full reinforcement across its width by the provision of bias yarn sub-assemblies across its full width followed for example by local reinforcement in the manner described with reference to FIG. 9.

The machine illustrated in FIG. 7 may furthermore be modified to provide for the formation of more complex yarn structures, for example, by duplicating the yarn transfer mechanism 18, arranging one of the mechanisms above the other for the production of two superposed bias yarn assemblies each of which comprises two bias yarn sub-assemblies of oppositely inclined bias yarns, providing upper and lower binding yarn insertion mechanisms 25 and programming the drive control unit 42 to produce first a main body portion in which the two bias yarn assemblies are held captive within the structure by binding warp yarns which pass from one outer face of the body portion to the other outer face of the body portion and then to form the structure in the form of two superposed sub-portions each of which extends from the main body portion, one of which contains one of the non-woven bias yarn assemblies, the other of which contains the other non-woven bias yarn assembly and each of which is held within the sub-portion by binding warp yarns provided by the upper and lower insertion needles of the upper and lower binding warp yarn insertion mechanisms.

A yarn structure thus produced can then be deformed to provide a finished structure of T-section and used to advantage in the formation of a T-section reinforced composite.

It will also be appreciated that the machine illustrated in FIG. 7 can be arranged to form yarn structures based on those illustrated in FIGS. 1A, 1B and 1C, but in which one or more additional non-woven yarn assemblies are interposed between the holding weft yarns and one or each face of the non-woven bias yarn assembly. For example, non-woven 90° suffer yarns may be interposed between the woven yarn assembly of warp yarns 33 and weft yarns 34*a* and 34*b* and the bias yarns 12 in the yarn structures illustrated in FIGS. 1B and 1C. Additionally a non-woven assembly of 90° stuffer yarns may be interposed between the woven assembly of warp yarns 29 and weft yarns 40*a* and 40*b* and the bias yarns 11 in the yarn structure illustrated in FIG. 1C.

It will also be appreciated that in alternative configurations non-woven assemblies of 0° warp yarns may be interposed in place of or in addition to the non-woven assemblies of 90° stuffer yarns.

I claim:

1. A method of forming a multi-axial yarn structure comprising the steps of:

advancing in a warp feed direction from a warp supply warp yarns in the form of a warp sheet, forming in a succession of bias yarn forming steps in which warp yarns of the warp sheet are displaced in opposite weft directions a non-woven bias yarn assembly comprising two superposed non-woven bias yarn subassemblies in which the bias yarns of one sub-assembly are inclined to the bias yarns of the other sub-assembly and in both of which the bias yarns are inclined to the warp feed direction, each bias yarn forming step comprising, advancing the warp warns from the warp supply through yarn guide openings of yarn guide means to hold the warp yarns in predetermined relative positions along the weft direction, shedding selected warp yarns from the warp supply to transfer the selected yarns from predetermined openings in the yarn guide means to openings in a yarn transfer means located at a predetermined initial yarn receiving position with respect to the yarn guide means, bringing the yarn transfer means to an offset position offset in the weft direction from the predetermined yarn receiving position by relative displacement of the yarn transfer means and the yarn guide means in the weft direction and, returning the selected warp yarns to the warp sheet to bring them into offset openings in the yarn guide means offset from the predetermined openings in the yarn guide means, carrying out the bias yarn forming steps to transfer each yarn from the opening it occupies in the yarn guide means to another opening in the yarn guide means to cause each yarn in a succession of forward transfer steps to follow the yarn preceding it from one opening to another along a non-intersecting path in a first direction until the yarn at a first end opening in the path arrives at a second end opening in the path located at the opposite end of the path from the first end opening and the yarn at the second end opening in the path arrives at the first end opening and then, in a succession of return transfer steps to follow the yarn preceding it from one opening to another along the non-intersecting path in a direction opposite the first direction until the yarn from the second end opening in the path arrives at the first end opening and the yarn from the first end opening arrives at the second end opening and, successively repeating the forward and return transfer steps.

2. A method according to claim 1, comprising advancing a first yarn through a first yarn guide opening located at one end of the yarn guide means, two yarns through each of a plurality of intermediate openings intermediate the first yarn guide opening and a last yarn guide opening and passing a last yarn through the last yarn guide opening, shedding in a first forward yarn transfer step the first and last and all the yarns in the intermediate openings to transfer them to corresponding openings in the yarn transfer means, moving the yarn transfer means one traverse space equal to one opening or a predetermined plurality of openings of the yarn guide means in a first weft direction and returning one yarn required to be moved in the first direction from each of the intermediate openings to offset openings in the yarn guide means, moving the yarn transfer means two traverse spaces in a second weft direction, opposite the first weft direction, returning the remaining yarns from the intermediate openings and the last yarn to offset openings in the yarn guide means offset two openings in the second weft direction, moving the yarn transfer means two traverse spaces in the first weft direction and returning the yarn from the first yarn guide opening to an offset opening in the yarn guide means offset one opening in the first weft direction, moving the yarn transfer means back one traverse space to its predetermined initial yarn receiving position to complete the first forward yarn transfer step, repeating the forward transfer step on the transferred yarns until the succession of forward transfer steps has been completed while, during transfer, including with the first yarn each successive yarn arriving at the first opening and then carrying out the succession of return yarn transfer steps.

3. A method according to claim 1, comprising the further steps of passing in each of a succession of binding warp yarn inserting steps binding warp yarns through the non-woven bias yarn assembly to form for each binding warp yarn, a first portion which passes through the non woven bias yarn assembly from a first face thereof to an opposite second face thereof, a second portion which passes from the second face to the first face and, a binding warp yarn loop portion which bridges the first and second portions at the second face, passing in the weft direction in each of a succession of weft insertion steps a holding weft yarn across the second face of the non-woven bias yarn assembly and through the binding yarn loop portions thereby to hold the binding warp yarns captive at the second face of the bias yarn assembly, and passing in the weft direction a holding weft yarn across the first face of the bias yarn assembly, repeating the binding warp yarn insertion step to form bridging binding yarn loop portions at the first face of the bias yarn assembly which are held captive at the first face of the assembly by the holding weft yarns at the first face and, beating up in a beating up step the structure thus formed to produce a three dimensional yarn structure, in which the yarns of the superposed bias yarn subassemblies are held in place in the structure by the binding warp yarns which are held by the holding weft yarns.

4. A method according to claim 3, wherein the non-woven bias yarn assembly is a first of a plurality of yarn assemblies, a second yarn assembly is formed over the second face of the non-woven first assembly and, the method further comprises the steps of, advancing in the feed direction warp yarns of the second yarn assembly in the form of a warp sheet, passing the binding warp yarns through the superposed sub-assemblies of the non-woven first assembly and the warp sheet of the second assembly to form the binding yarn loop portions, shedding the warp yarns of the warp sheet of the second assembly and, inserting holding weft yarns to form a woven second assembly and to hold the binding warp yarn loop portions captive at the second face of the first assembly.

5. A method according to claim 4, wherein a third yarn assembly is formed over the first face of the non-woven first assembly and, the method further comprises the steps of, advancing in the feed direction warp yarns of the third yarn assembly in the form of a warp sheet, passing the binding warp yarns through the warp sheet of the third yarn assembly, the superposed subassemblies of the non-woven first assembly and the warp sheet of the second assembly to form the binding yarn loop portions, shedding the warp yarns of the warp sheet of the second yarn assembly and inserting holding weft yearns to form a woven second assembly and no hold the binding warp yarn loop portions captive at the second face of the first assembly, and shedding the warp yarns of the warp sheet of the third yarn assembly and inserting holding weft yarns to form a woven third yarn assembly and to hold the binding warp yarn loop portions captive at the first face of the first assembly whereby the yarns of the superposed yarn sub-assemblies of the first assembly are held in place in the structure by binding warp yarns held by the holding weft yarns of the woven second and third yarn assemblies.

6. A method according to claim 3 wherein the three dimensional yarn structure is formed in a succession of cycles of operation in each of which a bias yarn forming step is followed by a binding warp yarn insertion step and two weft yarn insertion steps.

7. A method according to claim 3, wherein the three-dimensional yarn structure to be formed comprises in at least a first region thereof a main body portion having a first outer face and an opposite second outer face, the binding warp yarn inserting steps of the method comprise passing binding warp yarns through the non-woven bias yarn assembly from the first outer face of the body portion to the opposite second outer face of the body portion and, the weft yarn insertion steps of the method comprise passing holding weft yarns across the first and second outer faces to hold the binding yarn loop portions captive at the first and second outer faces.

8. A method according to claim 7, wherein the three-dimensional yarn structure to be formed comprises in a second region thereof first and second superposed sub-portions the first of which extends from the main body portion and has an outer face and an inner face and the second of which extends from the main body portion and has an outer face and an inner face opposing the inner face of the first sub-portion;

the binding warp yarn inserting steps of the method further comprise passing binding warp yarns through the non-woven warp yarn assembly from the outer face of the first sub-portion to the inner face thereof and;

the weft insertion steps of the method comprise passing holding weft yarns across the outer face and the inner face of the first sub-portion to hold captive the binding yarn loop portions at the outer and inner faces of the first sub-portion.

9. A method according to claim 8, wherein the second sub-portion in the second region of the structure to be formed includes a non-woven assembly, the binding warp yarn inserting steps of the method include passing binding warp yarns through the non-woven warp yarn assembly in the second sub-portion from the outer face thereof to the inner face thereof and;

the weft insertion steps of the method include passing holding weft yarns across the outer face and the inner face of the second sub-portion to hold captive the binding yarn loop portions at the outer and inner faces of the second sub-portion.

10. A method of forming a three dimensional yarn structure comprising the steps of advancing in a warp feed direction warp yarns in the form of a warp sheet, displacing in a succession of bias yarn forming steps warp yarns of the warp sheet in opposite weft directions to produce a non-woven bias first yarn assembly comprising two or more superposed non-woven bias yarn sub-assemblies in which the bias yarns of one subassembly are inclined to the bias yarns of the other subassembly and in both of which the bias yarns are inclined to the feed direction, passing in each of a succession of binding warp yarn inserting steps binding warp yarns through the non-woven bias yarn assembly to form for each binding warp yarn, a first portion which passes through the nonwoven bias yarn assembly from a first face thereof to an opposite second face thereof, a second portion which passes from the second face to the first face and, a binding warp yarn loop portion which bridges the first and second portions at the second face, passing in the weft direction in each of a succession of weft insertion steps a holding weft yarn across the second face of the assembly and through the binding yarn loop portions thereby to hold the binding warp yarns captive at the second face of the bias yarn assembly, and passing in the weft direction a holding weft yarn across the first face of the bias yarn assembly, repeating the binding warp yarn insertion step to form bridging binding yarn loop portions at the first face of the bias yarn assembly which are held captive at the first face of the assembly by the holding weft yarns at the first face and, beating up in a beating up step the structure thus formed to produce a three dimensional yarn structure, in which the yarns of the superposed bias yarn subassemblies are held in place in the structure by the binding warp yarns which are held by the holding weft yarns, characterized in that:

the non-woven bias yarn assembly is a first of a plurality of yarn assemblies, a second yarn assembly is formed over the second face of the non-woven first assembly, and the method further comprises the steps of, advancing in the feed direction warp yarns of the second yarn assembly in the form of a warp sheet, passing the binding warp yarns through the superposed sub-assemblies of the non-woven first assembly and the warp sheet of the second assembly to form the binding yarn loop portions, shedding the warp yarns of the warp sheet of the second assembly and, inserting holding weft yarns to form a woven second assembly and to hold the binding warp yarn loop portions captive at the second face of the first assembly.

11. A method according to claim 10, wherein a third yarn assembly is formed over the first face of the non-woven first assembly and, the method further comprises the steps of advancing in the feed direction warp yarns of the third yarn assembly in the form of a warp sheet, passing the binding warp yarns through the warp sheet of the third yarn assembly, the superposed subassemblies of the non-woven first assembly and the warp sheet of the second assembly to form the binding yarn loop portions, shedding the warp yarns of the warp sheet of the second yarn assembly and inserting holding weft yarns to form a woven second assembly and to hold the binding warp yarn loop portions captive at the second face of the first assembly, and shedding the warp yarns of the warp sheet of the third yarn assembly and inserting holding weft yarns to form a woven third yarn assembly and to hold the binding warp yarn loop portions captive at the first face of the first assembly whereby the yarns of the superposed yarn sub-assemblies of the first assembly are held in place in the structure by binding warp yarns held by the holding weft yarns of the woven second and third yarn assemblies.

12. A machine for forming a multi-axial yarn structure comprising warp yarn supply means for supplying in a warp feed direction warp yarns in the form of a warp sheet, and bias yarn forming means for forming in a succession of bias yarn forming steps in which warp yarns of the warp sheet are displaced in opposite weft directions a non-woven bias yarn assembly comprising two superposed non-woven bias yarn sub-assemblies in which the bias yarns of one sub-assembly are inclined to the bias yarns of the other sub-assembly and in both of which the bias yarns are inclined to the warp feed direction, the bias yarn forming means comprising yarn guide means defining yarn guide openings through which the warp yarns of the warp sheet pass and which hold the warp yarns in predetermined relative positions along the weft direction, yarn transfer means defining yarn transfer openings and being located at a predetermined initial yarn receiving position with respect to the yarn guide means, shedding means between the warp yarn supply means and for shedding selected warp yarns to transfer the selected yarns from predetermined openings in the yarn guide means to yarn transfer openings in the yarn transfer means at the initial yarn receiving position, yarn transfer drive means to cause relative displacement of the yarn transfer means and the yarn guide means in the weft direction to bring the yarn transfer means to an offset position offset from the yarn receiving position and thereby to bring the selected warp yarns upon their return to the warp sheet into openings in the yarn guide means offset from the predetermined openings in the yarn guide means and, drive control means to drive the shedding means and the yarn transfer drive means to transfer each yarn from the opening it occupies in the yarn guide means to another opening in the yarn guide means in such a manner that each yarn is caused in a succession of forward transfer steps to follow the yarn preceding it from one opening to another along a non-intersecting path until the yarn at a first end opening in the path arrives at a second end opening in the path located at the opposite end of the path from the first end opening and the yarn at the second end opening in the path arrives at the first end opening and then in a succession of return transfer steps to follow the yarn preceding it from one opening to another along the non-intersecting path in the opposite direction until the yarn from the second end opening in the path arrives at the first end opening and the yarn from the first end opening arrives at the second end opening and successively repeating the forward and return transfer steps.

13. A machine according to claim 12 wherein the warp yarn supply means is arranged to advance a first yarn through a first yarn guide opening located at one end of the yarn guide means, two yarns through each of a plurality of intermediate openings intermediate the first yarn guide opening and a last yarn guide opening and a last yarn through the last yarn guide opening, and the drive control means drives the shedding means and the yarn transfer means, to shed in a first forward yarn transfer step the first and last and all the yarns in the intermediate openings to transfer them to corresponding openings in the yarn transfer means, to move the yarn transfer means one traverse space equal to one opening or a predetermined plurality of openings of the yarn guide means in a first weft direction and to return one yarn required to be moved in the first direction from each of the intermediate openings to offset openings in the yarn guide means, to move the yarn transfer means two traverse spaces in a second weft direction opposite the first weft direction and to return the remaining yarns from the intermediate openings and the last yarn to offset openings in the yarn guide means offset two openings in the second weft direction, to move the yarn transfer means two traverse spaces in the first weft direction and to return the yarn from the first yarn guide opening to an offset opening in the yarn guide means offset one opening in the first weft direction, to move the yarn transfer means back one traverse space to its predetermined initial yarn receiving position to complete the first forward yarn transfer step, to repeat the forward transfer step on the transferred yarns until the succession of forward transfer steps has been completed while, during transfer, to include with the first yarn each successive yarn arriving at the first yarn guide opening and, then to carry out the succession of return yarn transfer steps.

14. A machine according to claim 12 further comprising binding warp yarn insertion means for passing in each of a succession of binding warp yarn inserting steps binding warp yarns through the non-woven warp yarn assembly to form for each binding warp yarn, a first portion which passes through the nonwoven first yarn assembly from a first face thereof to an opposite second face thereof, a second portion which passes from the second face to the first face and, a binding warp yarn loop portion which bridges the first and second portions at the second face, weft insertion means for passing in the weft direction in each of a succession of weft insertion steps, a holding weft yarn across the second face of the assembly and through the binding yarn loop portions thereby to hold the binding warp yarns captive at the second face of the assembly, and, a holding weft yarn across the first face of the assembly whereby repetition of the binding yarn insertion step forms bridging binding yarn loop portions at the first face which are held captive at the first face of the assembly by the holding weft yarns at the first face and, beater means for beating up to produce a three dimensional yarn structure, in which the yarns of the superposed sub-assemblies of the first assembly are held in place in the structure by the binding warp yarns which are held by the holding weft yarns.

15. A machine according to claim 14, wherein the non-woven assembly is a first of a plurality of yarn assemblies, a second yarn assembly is formed over the second face of the non-woven first assembly, the supply means supplies in the warp feed direction warp yarns of the second yarn assembly in the form of a warp sheet, and wherein the machine further comprises shedding means for shedding the warp yarns of the warp sheet of the second assembly after passage of the binding warp yarns through the superposed sub-assemblies of the non-woven first assembly and the warp sheet of the second assembly to form the binding yarn loop portions, and the weft insertion means is arranged to insert holding weft yarns to form a woven second assembly and to hold the binding warp yarn loop portions captive at the second face of the first assembly.

16. A machine according to claim 15, wherein a third yarn assembly is formed over the first face of the non-woven assembly, the supply means supplies in the feed direction warp yarns of the third yarn assembly in the form of a warp sheet, the machine comprises shedding means for shedding the warp yarns of the warp sheet of the third yarn assembly after passage of the binding warp yarns through the warp sheet of the third yarn assembly, the superposed sub-assemblies of the non-woven first assembly and the warp sheet of the second assembly to form the binding yarn loop portions, and the weft insertion means is arranged to insert holding weft yarns to form a woven third yarn assembly and to hold the binding warp yarn loop portions captive at the first face of the first assembly.

17. A machine for forming a three dimensional yarn structure comprising warp yarn supply means for supplying in a warp feed direction warp yarns in the form of a warp sheet, bias yarn forming means for forming in a succession of bias yarn forming steps in which warp yarns of the warp sheet are displaced in opposite weft directions a non-woven bias yarn assembly comprising two or more superposed non-woven bias yarn sub-assemblies in which the bias yarns of one sub-assembly are inclined to the bias yarns of the other sub-assembly and both of which the bias yarns are inclined to the feed direction, binding warp yarn insertion means for passing in each of a succession of binding warp yarn inserting steps binding warp yarns through the non-woven warp yarn assembly to form for each binding warp yarn:

a first portion which passes through the nonwoven first yarn assembly from a first face thereof to an opposite face thereof, a second portion which passes from the second face to the first face and, a binding wrap yarn loop portion which bridges the first and second portions at the second face, weft insertion means for passing in the weft direction in each of a succession of weft insertion steps:

a holding weft yarn across the second face of the assembly and through the binding yarn loop portions thereby to hold the binding warp yarns captive at the second face of the assembly, and, a holding weft yarn across the first face of the assembly whereby repetition of the binding yarn insertion step forms bridging yarn loop portions at the first face which are held captive at the first face of the assembly by the holding weft yarns at the first face, beater means for beating up to produce the three dimensional yarn structure, in which the yarns of the superposed sub-assemblies of the first assembly are held in place in the structure by the binding warp yarns which are held by the holding weft yarns, characterized in that:

the non-woven assembly is a first of a plurality of yarn assemblies, and a second yarn assembly is formed over the second face of the non-woven first assembly, the supply means supplies in the feed direction warp yarns of the second yarn assembly in the form of a warp sheet, and the machine further comprises shedding means for shedding the warp yarns of the warp sheet of the second assembly after passage of the binding warp yarns through the superposed sub-assemblies of the non-woven first assembly and the warp sheet of the second assembly to form the binding yarn loop portions, and the weft insertion means is arranged to insert holding weft yarns to form a woven second assembly and to hold the binding warp yarn loop portions captive at the second face of the first assembly.

18. A machine according to claim 17, wherein a third yarn assembly is formed over the first face of the non-woven first assembly the supply means supplies in the feed direction warp yarns of the third yarn assembly in the form of a warp sheet, the machine comprises shedding means for shedding the warp yarns of the warp sheet of the third yarn assembly after passage of the binding warp yarns through the warp sheet of the third yarn assembly, the superposed sub-assemblies of the non-woven first assembly and the warp sheet of the second assembly to form the binding yarn loop portions, and the weft insertion means is arranged to insert holding weft yarns to form a woven third yarn assembly and to hold the binding warp yarn loop portions captive at the first face of the first assembly.

19. A three dimensional yarn structure comprising a non-woven first yarn assembly which has a first face and an opposite second face and which comprises two or more superposed non-woven warp yarn sub-assemblies in which the warp yarns of one sub-assembly are inclined to the warp yarns of the other sub-assembly and in both of which the warp yarns are inclined to a reference warp feed direction, a second yarn assembly which comprises holding weft yarns which extend across the second face of the first assembly, a third yarn assembly comprising holding weft yarns which extend across the first face of the first assembly, a binding yarn assembly comprising binding warp yarns each of which follows a continuous path and comprises, first portions which pass through the non-woven first yarn assembly from the first face thereof to the second face thereof, second portions which pass from the second face to the first face and, binding yarn loop portions bridging the first and second portions at the first face of the first assembly and binding yarn loop portions bridging the first and second portions at the second face of the first assembly, the holding weft yarns of the second assembly passing through binding yarn loop portions at the second face of the first assembly to hold the binding yarn loop portions captive at the second face of the first assembly, the holding weft yarns of the third assembly passing through the yarn binding loop portions at the first face of the first assembly to hold the loop portions captive at the first face of the first assembly, and, the second yarn assembly comprising a warp yarn sub-assembly and a weft yarn sub-assembly which includes the holding weft yarns which are woven with the warp yarns of the warp yarn sub-assembly to form the second yarn assembly.

20. A structure according to claim 19 wherein the third yarn assembly comprises a warp yarn sub-assembly and a weft yarn sub-assembly which includes the holding weft yarns which are woven with the warp yarns of the warp yarn sub-assembly to form the third yarn assembly.

21. A structure according to claim 19, wherein the structure comprises in at least a first region thereof a main body portion having a first outer face and an opposite second outer face, the first face of the non-woven yarn assembly lies at the first outer face of the body portion and, the second face of the non-woven yarn assembly lies at the opposite second outer face of the body portion.

22. A structure according to claim 2, wherein the structure in a second region thereof comprises first and second superposed sub-portions, the first of the sub-portions extends from the main body portion and has an outer face and an inner face, the second of the sub-portions extends from the main body portion and has an outer face and an inner face opposing the inner face of the first sub-portion, the first sub-portion includes the non-woven assembly and, the first face of the non-woven yarn assembly lies at the outer face of the first sub-portion and a first inner face face of the non-woven assembly lies at the inner face of the first sub-portion.

23. A structure according to claim 22, wherein the first and second sub-portions are separable sub-portions.

24. A structure according to claim 22, wherein the second sub-portion includes a non-woven yarn assembly and, the second face of the non-woven assembly lies at the outer face of the second sub-portion and a second inner face of the non-woven assembly lies at the inner face of the second sub-portion.

25. A structure according to claim 19 produced by the method according to claim 1.

* * * * *